US010689876B2

(12) United States Patent
Richards

(10) Patent No.: US 10,689,876 B2
(45) **Date of Patent: *Jun. 23, 2020**

(54) BEAM-TO-COLUMN CONNECTION SYSTEMS AND MOMENT-RESISTING FRAMES INCLUDING THE SAME

(71) Applicant: DURAFUSE FRAMES, LLC, West Jordan, UT (US)

(72) Inventor: Paul William Richards, Orem, UT (US)

(73) Assignee: DURAFUSE FRAMES, LLC, West Jordan, UT (US)

( * ) Notice: Subject to any disclaimer, the term of this patent is extended or adjusted under 35 U.S.C. 154(b) by 13 days.

This patent is subject to a terminal disclaimer.

(21) Appl. No.: 16/101,075

(22) Filed: Aug. 10, 2018

(65) Prior Publication Data

US 2018/0347222 A1 Dec. 6, 2018

Related U.S. Application Data

(63) Continuation-in-part of application No. 15/516,834, filed as application No. PCT/US2016/065623 on Dec. 8, 2016.

(Continued)

(51) Int. Cl.
*E04B 1/08* (2006.01)
*E04B 1/18* (2006.01)
(Continued)

(52) U.S. Cl.
CPC ..... *E04H 9/021* (2013.01); *E04B 1/2403* (2013.01); *E04H 9/024* (2013.01);
(Continued)

(58) Field of Classification Search
CPC ... E04C 5/162; E04C 3/32; E04C 3/30; E04B 1/2403; E04B 2001/2415;
(Continued)

(56) References Cited

U.S. PATENT DOCUMENTS 1,727,293 A * 9/1929 Larkin ..... E04B 1/2403 403/173
4,014,089 A * 3/1977 Sato ..... E04B 1/2403 29/525.11

(Continued)

FOREIGN PATENT DOCUMENTS

JP 2000144901 A 5/2000
KR 100516332 B1 9/2005

(Continued)

OTHER PUBLICATIONS

International Search Report and Written Opinion from International Application No. PCT/US16/65623 dated Mar. 10, 2017.

(Continued)

*Primary Examiner* — Phi D A
(74) *Attorney, Agent, or Firm* — Dorsey & Whitney LLP

(57) ABSTRACT

Embodiments disclosed herein relate to a beam-to-column connection systems for a moment-resisting frame as well as moment-resisting frames that include such connection systems.

26 Claims, 15 Drawing Sheets

Related U.S. Application Data

(60) Provisional application No. 62/265,362, filed on Dec. 9, 2015, provisional application No. 62/549,853, filed on Aug. 24, 2017.

(51) Int. Cl.
*E04H 9/02* (2006.01)
*E04B 1/24* (2006.01)

(52) U.S. Cl.
CPC ..... *E04B 2001/2415* (2013.01); *E04B 2001/2418* (2013.01); *E04B 2001/2442* (2013.01); *E04B 2001/2457* (2013.01); *E04B 2001/2466* (2013.01)

(58) Field of Classification Search
CPC ..... E04B 2001/2418; E04B 2001/2448; E04H 12/08; E04H 9/021
See application file for complete search history.

(56) References Cited

U.S. PATENT DOCUMENTS

| | | | | |
|---|---|---|---|---|
| 5,148,642 | A | 9/1992 | Plumier et al. | |
| 5,660,017 | A * | 8/1997 | Houghton | E04B 1/2403 52/167.3 |
| 6,138,427 | A * | 10/2000 | Houghton | E04B 1/2403 52/236.3 |
| 2002/0184836 | A1 | 12/2002 | Takeuchi et al. | |
| 2004/0050013 | A1* | 3/2004 | Okada | E04B 1/2403 52/848 |
| 2004/0200178 | A1* | 10/2004 | Simmons | E04B 1/24 52/633 |
| 2005/0204684 | A1 | 9/2005 | Houghton | |
| 2006/0144006 | A1* | 7/2006 | Suzuki | E04B 1/2403 52/655.1 |
| 2006/0265992 | A1 | 11/2006 | Hiragaki | |
| 2009/0223166 | A1* | 9/2009 | Ohata | E04B 1/2403 52/699 |
| 2010/0205891 | A1* | 8/2010 | Bong | B23K 33/004 52/655.1 |
| 2011/0030305 | A1* | 2/2011 | Karns | E04B 1/2403 52/650.1 |
| 2014/0182234 | A1* | 7/2014 | Yang | E04B 1/24 52/655.1 |
| 2014/0325932 | A1 | 11/2014 | Karns et al. | |
| 2015/0096244 | A1 | 4/2015 | Richards | |
| 2015/0275501 | A1* | 10/2015 | Houghton | E04B 1/2403 52/854 |
| 2018/0266099 | A1* | 9/2018 | Lippert | E04B 1/2403 |

FOREIGN PATENT DOCUMENTS

| | | | |
|---|---|---|---|
| WO | 2016036564 | A1 | 3/2016 |
| WO | 2017100453 | A1 | 6/2017 |

OTHER PUBLICATIONS

International Search Report and Written Opinion from International Application No. PCT/US2015/047006 dated Nov. 23, 2015.
Non-Final Office Action for U.S. Appl. No. 15/500,991 dated Jan. 18, 2018.
Notice of Allowance for U.S. Appl. No. 15/500,991 dated Jun. 18, 2018.
U.S. Appl. No. 15/516,834, filed Apr. 4, 2017.
U.S. Appl. No. 62/265,362, filed Dec. 9, 2015.
U.S. Appl. No. 62/549,853, filed Aug. 24, 2017.
Corrected Notice of Allowance for U.S. Appl. No. 15/500,991 dated May 8, 2019.
International Search Report and Written Opinion for International Application No. PCT/US2018/046222 dated Nov. 14, 2018.
Issue Notification for U.S. Appl. No. 15/500,991 dated May 22, 2019.
Non-Final Office Action for U.S. Appl. No. 15/516,834 dated Aug. 30, 2018.
Notice of Allowance for U.S. Appl. No. 15/500,991 dated Oct. 2, 2018.
Notice of Allowance for U.S. Appl. No. 15/516,834 dated Jun. 26, 2019.
Notice of Allowance for U.S. Appl. No. 15/516,834 dated Mar. 8, 2019.
U.S. Appl. No. 62/044,738, filed Sep. 2, 2014.
Notice of Allowance for U.S. Appl. No. 15/516,834 dated Apr. 1, 2020.
Supplemental Notice of Allowability for U.S. Appl. No. 15/516,834.

* cited by examiner

BEAM-TO-COLUMN CONNECTION SYSTEMS AND MOMENT-RESISTING FRAMES INCLUDING THE SAME

CROSS-REFERENCE TO RELATED APPLICATIONS

This application claims priority to U.S. Provisional Application No. 62/549,853 filed on Aug. 24, 2017 and is a continuation-in-part application of U.S. patent application Ser. No. 15/516,834 filed on Apr. 4, 2017, which is a U.S. National Stage of International Application No. PCT/US2016/065623 filed on Dec. 8, 2016, which claims priority to U.S. Provisional Application No. 62/265,362 filed on Dec. 9, 2015. The disclosures of each of the foregoing applications are incorporated herein, in their entireties, by this reference.

BACKGROUND

Typically, structural beam-to-column connections in moment-resisting frames may be very expensive to build, because they include multiple parts that must be fitted and then welded together. For example, the parts required for the moment-resisting frame may include a column, column continuity plates, column doubler plates, and a beam. The welding between the beam and the column is typically performed in the field and may be particularly expensive. Another connection type includes a flange-plate moment connection and addresses the expense of welding. Generally, however, when the frame experiences a seismic event, the connection between the beam and the column is such that the failure or yielding of the frame occurs at a location on the beam, which is near but not at the connection.

Accordingly, designers and manufacturers of moment-resisting frame continue to seek improvements thereto.

SUMMARY

Embodiments disclosed herein relate to a moment-resisting frame as well as to a connection system and a moment-resisting frame that includes such plate. In an embodiment, a beam-to-column connection system is disclosed. The beam-to-column connection system includes a plurality of splice plates configured to be secured to a column and to be spaced from each other. The beam-to-column connection system also includes a plate including at least one first beam-connection portion and at least one first splice plate-connection portion. The at least one first beam-connection portion is configured to connect to a top flange of a beam. The at least one first splice plate-connection portion is configured to connect to two or more of the plurality of splice plates. The beam-to-column connection system also includes a seismic fuse plate including at least one second beam-connection portion, at least one second splice plate-connection portion, and at least one shear portion extending between the second beam-connection portion and the second splice plate-connection portion. The at least one second beam-connection portion is configured to connect to a bottom flange of the beam. The at least one second splice plate-connection portion is configured to connect to a remainder of the plurality of splice plates.

In an embodiment, a moment-resisting frame is disclosed. The moment-resisting frame includes a column and a beam. The beam includes a top flange, a bottom flange, and a web extending between the top flange and the bottom flange. The moment-resisting frame also includes a beam-to-column connection system connecting the beam to the column. The beam-to-column connection system includes a plurality of splice plates secured to the column and spaced from each other. The beam-to-column connection system also includes a plate including a first beam-connection portion and a first splice plate-connection portion. The first beam-connection portion is connected to the top flange of the beam. The first splice plate-connection portion is connected to two or more of the plurality of splice plates. The beam-to-column connection system further includes a seismic fuse plate including a second beam-connection portion, a second splice plate-connection portion, and a shear portion extending between the second beam-connection portion and the second splice plate-connection portion. The second beam-connection portion is connected to the bottom flange of the beam and the second splice plate-connection portion is connected to a remainder of the plurality of splice plates.

In an embodiment, a beam-to-column connection system is disclosed. The beam-to-column connection system includes at least four splice plates configured to be secured to a column and to be spaced from each other. The at least four splice plates exhibits a sheet-like shape. The beam-to-column connection system also includes a plate including a first beam-connection portion and a first splice plate-connection portion. The first beam-connection portion is configured to connect to a top flange of a beam and the first splice plate-connection portion is configured to connect to two or more of the at least four splice plates. The beam-to-column connection system further includes a seismic fuse plate exhibiting single piece construction. The seismic fuse plate includes a second beam-connection portion configured to connect to a bottom flange of the beam, two second splice plate-connection portions configured to connect to a remainder of the at least four splice plates, and two shear portions that each extend between the second beam-connection portion and a corresponding one of the two second splice plate-connection portions. Each of the two shear portions defines at least one opening. Each of the second beam-connection portion, the two second splice plate-connection portions, and the two shear portions exhibit a generally rectangular shape. The second beam-connection portion, the two second splice plate-connection portions, and the two shear portions define two exterior recesses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1:
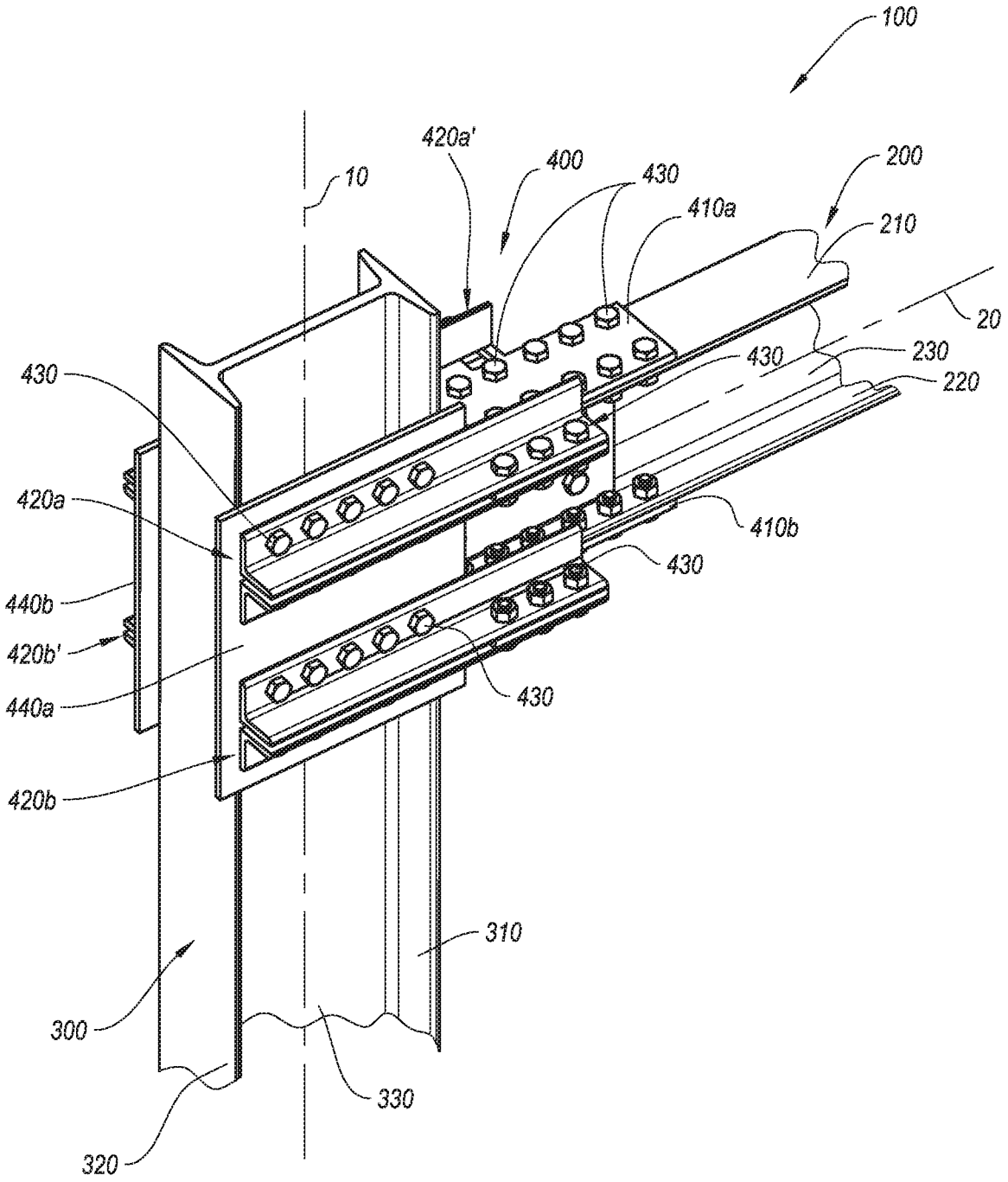
FIG. 1 is an isometric partial view of a moment-resisting frame, according to an embodiment.

Embodiments disclosed herein relate to at least one plate (e.g., a plate including at least one shear portion or a plate that does not include at least one shear portion) for a moment-resisting frame as well as to a connection system and a moment-resisting frame that includes such plate. Specifically, the plate may be configured and positioned such that movement or tilting of the moment-resisting frame exerts shear forces on one or more portions of the plate. For example, as the moment-resisting frame experiences a seismic event (e.g., an event that may exert forces onto the moment-resisting frame, which may tilt or reconfigure the moment-resisting frame from a generally rectangular configuration to a parallelogram configuration), the plate may be subjected to shear force that may preferentially fail the plate instead of a column or at least one beam (e.g., a single beam or a plurality of beams) connected to the column by the connection system that includes the plate.

In some embodiments, the connection system may be configured to prevent or reduce the likelihood of buckling at one or more portions of the beam and/or column connected by the connection system. For example, failure resulting from shear forces experienced by the plate at the connection system may accommodate or allow greater relative rotation or pivoting between the beam and column connected by the connection system (e.g., as compared with a conventional connection system) without failure of the beam and/or column. Facilitating increased tilting between the beam and column connected by the connection system (compared with a conventional connection) without buckling the beam and/or column may prevent failure or deformation of the beam (e.g., which may be more costly to repair than repairing or replacing the connection system). For example, instead of buckling or otherwise plastically deforming the beam, during a seismic event, the plate may experience elastic and/or plastic deformation resulting from the shear forces experienced thereby, while the deformations experienced by the beam and the column may remain in the elastic region, thereby preventing damage to the beam and column. Moreover, one or more portions of the connection system (e.g., the plate) may be replaced. As noted above, replacing a failed or plastically deformed plate may be easier and/or less expensive than replacing a failed or plastically deformed beam or column.

Generally, the plate may have any number of suitable configurations, such that the plate may be subjected to and/or fail due to shear forces (e.g., in a seismic event) of a selected magnitude. In an embodiment, the plate may include at least one shear portion that may selectively fail during a seismic event, may have any suitable shape and/or cross-section that may have a suitable shear strength. In such an embodiment, the plate is a seismic fuse plate. In an embodiment, the plate does not include at least one shear portion. Hence, for example, by selecting a suitable shear strength for the shear portion(s) of the plate or omitting the shear portion(s) from the plate, the moment-resisting frame may be configured such as to fail due to the shear forces applied at the shear portion of the plate, while the column and beam connected by the connection system may remain undamaged.

In an embodiment, the moment-resisting frame can include a plurality of plates. In such an embodiment, at least one of the plates include at least one shear portion and a remainder of the plates do not include at least one shear portion. As such, the at least one plate that include the shear portion can fail preferentially relative to the plates that do not include the shear portion.

FIG. 1 is an isometric partial view of a moment-resisting frame 100 according to an embodiment. Specifically, the moment-resisting frame 100 illustrated in FIG. 1 includes a beam 200 connected to a column 300 by a beam-to-column connection system 400. As described above, the beam-to-column connection system 400 may include one or more seismic fuse plates, such as first and second seismic fuse plates 410*a*, 410*b*, which may selectively fail or elastically deform during a seismic event, thereby absorbing energy (e.g., in the a manner that may protect or prevent plastic deformation of the beam 200 and/or of the column 300).

Generally, the beam-to-column connection system 400 may include any number of suitable connections that may be configured to connect the first seismic fuse plate 410*a* and/or second seismic fuse plate 410*b* to the column 300, such as with a plurality of splice plates. In the illustrated embodiment, the first seismic fuse plate 410*a* may be connected to the column 300 by opposing first and second pairs of splice plates 420*a*, 420*a*'. Similarly, the seismic fuse plate 410*b* may be connected to the column 300 by opposing third pair of splice plates 420*b* and fourth pairs of splice plates 420*b*'. In the illustrated embodiment, multiple respective fasteners (e.g., bolts 430) may connect the first and second pairs of splice plates 420*a*, 420*a*' to the first seismic fuse plate 410*a*. Likewise, in the illustrated embodiment, the first seismic fuse plate 410*a* may be connected to the beam 200 with multiple fasteners (e.g., bolts 430). Similarly, the seismic fuse plate 410*b* may be connected to the third pair of splice plates 420*b* and to the fourth splice plate 420*b*' by one or more fasteners, such as by bolts 430.

The first and second pairs of splice plates 420*a*, 420*a*' may extend outward from the column 300 (e.g., generally in the direction of the beam 200). In the illustrated embodiment, the beam-to-column connection system 400 may include doubler plates 440*a*, 440*b* that may be secured to the column 300. For example, the doubler plates 440*a*, 440*b* may be welded or otherwise secured to the column 300 with any number of suitable fastening mechanisms (e.g., fasteners, such as bolts, rivets, etc., welds, etc.). In an embodiment, the first pair of splice plates 420*a* may be secured to the doubler plate 440*a* (e.g., the first pair of splice plates 420*a* may be fastened to the doubler plate 440*a* by welding or with one or more fasteners, such as with bolts 430). Similarly, the second first pair of splice plates 420*a*' may be connected to the doubler plate 440*b* (e.g., the second first pair of splice plates 420*a*' may be fastened to the doubler plate 440*b* by welding or with one or more fasteners, such as with one or more bolts).

Also, the third pair of splice plates 420*b* may be secured to the doubler plate 440*a* by welding or with one or more fasteners (e.g., with one or more bolts 430). Hence, for example, the first pair of splice plates 420*a* and the third pair of splice plates 420*b* may be positioned on the same side of the column 300 and may be spaced apart from each other. Also, the fourth pair of splice plates 420*b*' may be secured to the doubler plate 440*b* by welding or with one or more fasteners (e.g., with one or more bolts 430). Moreover, for example, the second pair of splice plates 420*a*' and the fourth pair of splice plates 420*b*' may be located on the same side of the column 300 (e.g., opposite to the respective first pair of splice plates 420*a* and the third pair of splice plates 420*b*). Similarly, the second pair of splice plates 420*a*' and the fourth splice plates may be spaced apart along the column 300 (e.g., the second pair of splice plates 420*a*' may have generally the same longitudinal position along the column 300 as the first pair of splice plates 420*a*, and the fourth pair of splice plates 420*b*' may have generally the same longitudinal position along the column 300 as the 420*b*).

In the illustrated embodiment, the first pair of splice plates 420*a* is positioned above the third pair of splice plates 420*b* along the column 300. For example, the first pair of splice plates 420*a* may secure a portion of the first seismic fuse plate 410*a*, and the third pair of splice plates 420*b* may secure a portion of the seismic fuse plate 410*b*. The first seismic fuse plate 410*a* may be spaced apart from (e.g., positioned above) the second seismic fuse plate 410*b*, such that the beam 200 may be positioned between the first and second seismic fuse plates 410*a*, 410*b* and secured thereto. For example, as described above the first and second seismic fuse plates 410*a*, 410*b* may secure the beam 200 to the column, such that the beam 200 is secured between the first and second seismic fuse plates 410*a*, 410*b*.

The beam 200 may be an I-beam that has a top flange 210, a bottom flange 220, and a web 230 extending therebetween. It should be appreciated that the beam 200 may have any number of suitable shapes (e.g., round tube, square tube, etc.). In the embodiment shown in FIG. 1, the first seismic fuse plate 410*a* may be secured to the top flange 210, and the seismic fuse plate 410*b* may be secured to the bottom flange 220 of the beam 200 (e.g., the beam 200 may be oriented relative to the column 300, such that the top flange 210 and the bottom flange 220 are spaced from each other along a direction that is generally parallel to the longitudinal direction of the column 300). Hence, for example, the first seismic fuse plate 410*a* and seismic fuse plate 410*b* may position and orient the beam 200 at a suitable orientation and position relative to the column 300.

Generally, the first seismic fuse plate 410*a* and the second seismic fuse plate 410*b* may extend outward from the column 300 in the same direction as the beam 200. In the illustrated embodiment, the first seismic fuse plate 410*a* and the second seismic fuse plate 410*b* orient the beam 200 substantially perpendicularly relative to the column 300 (e.g., the column 300 may be oriented along a substantially vertical axis 10, the beam 200 may be oriented generally along a substantially horizontal axis 20, and the vertical and horizontal axes 10, 20 may be substantially perpendicular to each other). In additional or alternative embodiments, the beam 200 may be oriented at any suitable angle relative to the column 300 (e.g., at obtuse or acute angles relative to the column 300). For example, the first, second, third, and fourth pairs of splice plates 420*a*, 420*a*', 420*b*, 420*b*' may be secured to the corresponding doubler plates 440*a*, 440*b*, such as to form a suitable angle relative to the column 300 and to orient the beam 200 at the suitable angle relative to the column 300.

The first and second pairs of splice plates 420*a*, 420*a*', and the third and fourth pairs of splice plates 420*b*, 420*b*' may be spaced apart by a suitable distance, such as to accommodate the beam 200 of any selected thickness (e.g., thickness that may be defined by distance between the outer surfaces of the top flange 210 and bottom flange 220). That is, the first seismic fuse plate 410*a* and the second seismic fuse plate 410*b* may be positioned at suitable distance along the column 300 to secure the beam 200 of any selected thickness. Moreover, the beam-to-column connection system 400 may be positioned at any suitable height along the column 300, such that the beam 200 is positioned at a corresponding suitable height.

In the illustrated embodiment, the column 300 is an I-beam that includes flanges 310, 320 and a web 330 therebetween. For example, the column 300 may be axially oriented and/or centered about the axis 10, such that axis 10 is positioned midway between the flanges 310 and 320. In an embodiment, the flanges 310, 320 may be generally perpendicular to the axis 20 that may be generally perpendicular to the axis 10 (e.g., the longitudinal direction of the beam 200 may be generally perpendicular to the outer surfaces of the flanges 310 and 320). It should be appreciated, however, that the beam 200 may have any number of suitable orientations relative to the shape of the column 300 (e.g., relative to the flanges 310 and/or 320). Moreover, the column 300 may have any number of suitable cross-sectional shapes (e.g., tubular rectangle, tubular round, etc.).

In the illustrated example, the first seismic fuse plate 410*a* and second seismic fuse plate 410*b* are connected to the column 300 by the first and second pairs of splice plates 420*a*, 420*a*' and the third and fourth pairs of splice plates 420*b*, 420*b*' (respectively) that are connected to the doubler plates 440*a*, 440*b*. In particular, in the illustrated embodiment, the doubler plates 440*a*, 440*b* may be connected to the column 300 with one or more welds (e.g., fillet welds may connect the 440*a*, 440*b* to the flanges 310, 320). Generally, however, the first seismic fuse plate 410*a* and the second seismic fuse plate 410*b* may be connected to the column 300 with any number of suitable connect systems and mechanism. Examples of suitable connection systems and mechanisms are more fully described in PCT International Application No. PCT/US2015/047006 filed on 26 Aug. 2015, the disclosure of which is incorporated herein in its entirety by this reference.

Figure 2A:
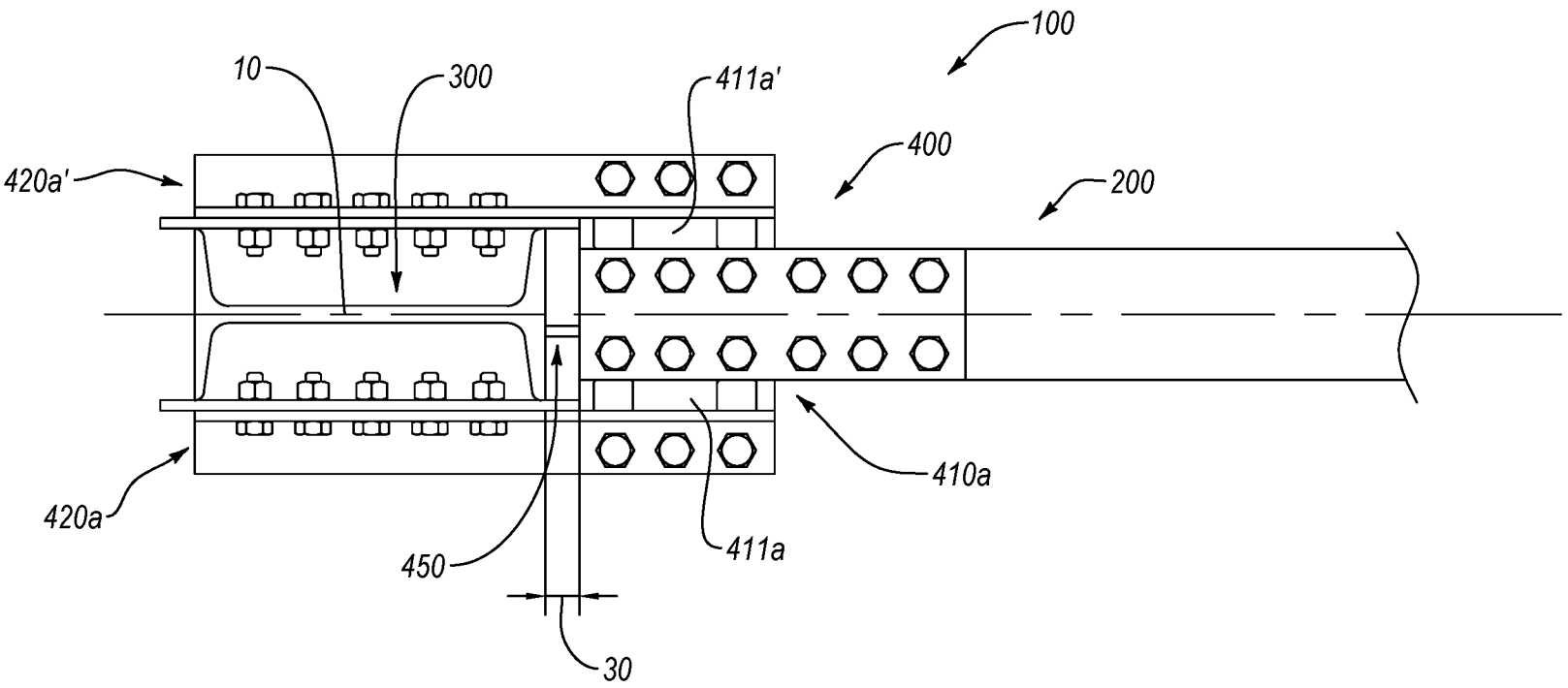
FIG. 2A is a top partial view of the moment-resisting frame of FIG. 1.
Figure 2B:
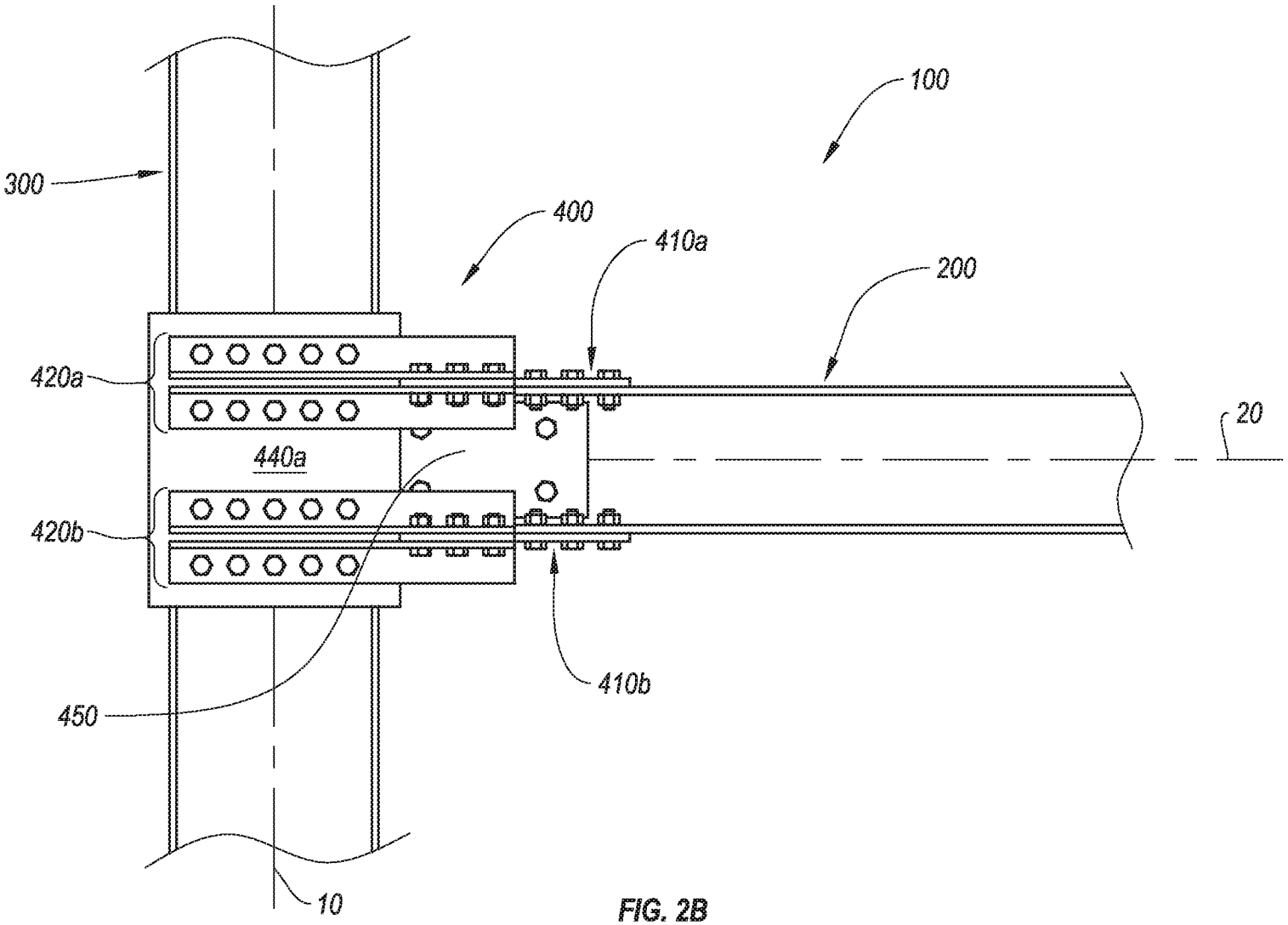
FIG. 2B is a front partial view of the moment-resisting frame of FIG. 1.
Figure 2C:
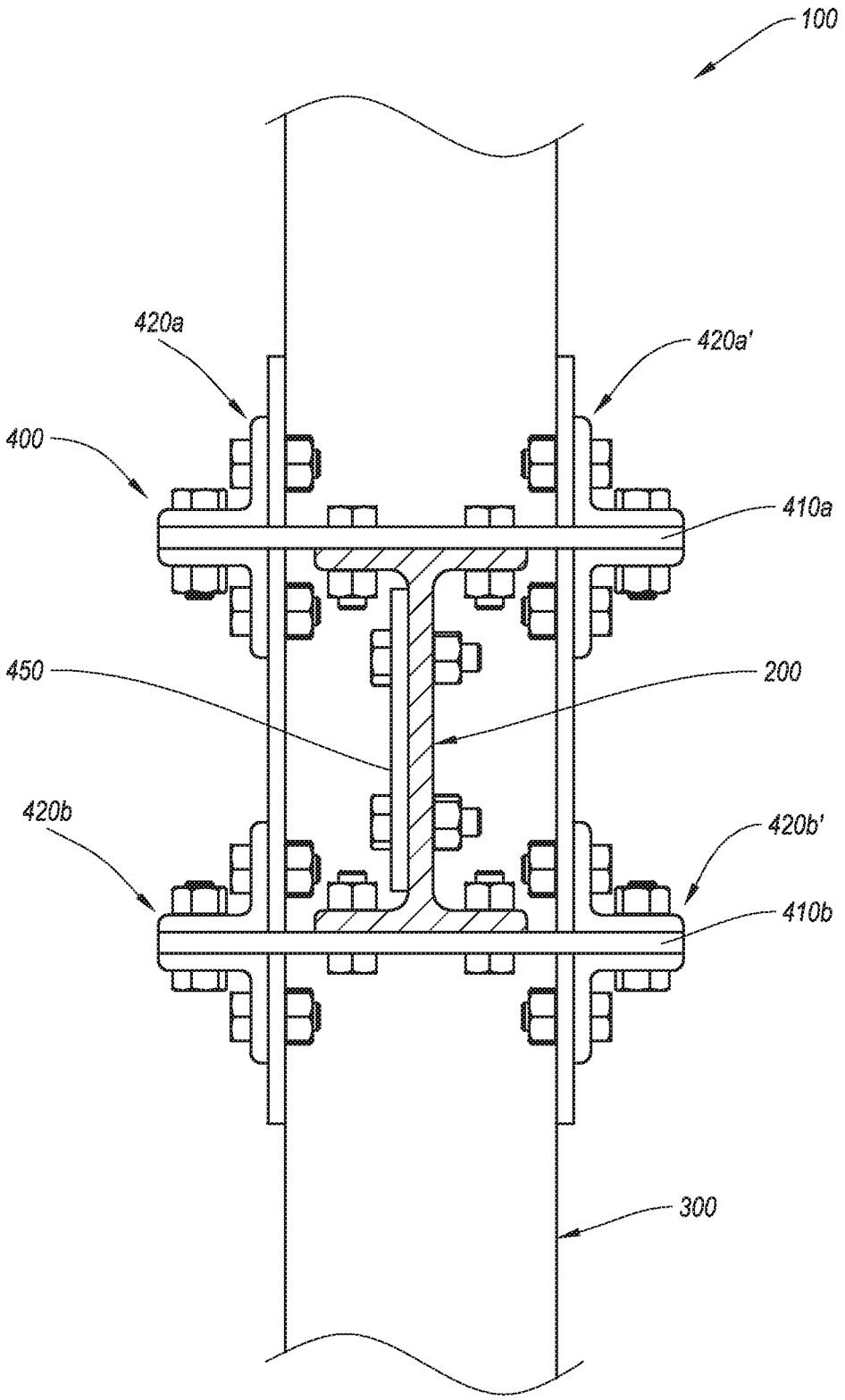
FIG. 2C is an end partial view of the moment-resisting frame of FIG. 1.

FIGS. 2A-2C are partial top, front, and end views, respectively, of the moment-resisting frame 100. Conventionally, the beam secured to the column may have a weakened portioned (e.g., near the connection location) that may fail or plastically deform during a seismic event. For example, conventional moment-resisting frames or frame connections may be configured in a manner that allows one or more portions of the beam to plastically deform, thereby absorbing some of the energy that the seismic event delivered to the moment-resisting frame (e.g., to avoid critical damage to or failure of the frame).

In particular, for example, the first seismic fuse plate 410*a* and the second seismic fuse plate 410*b* may fail or plastically deform, to absorb energy from the seismic event, due to shear forces experience thereby (e.g., forces in a direction generally parallel to the axis 20). As described above, the seismic fuse plate(s), such as the first and second seismic fuse plates 410*a*, 410*b*, may absorb some of the energy that a seismic event may deliver to the moment-resisting frame 100. Specifically, for example, dissipating the energy from the seismic event by allowing the seismic fuse plate(s) to deform and/or at least partially shear may prevent or avoid deformations to the beam 200 and/or to the column 300 (e.g., that may otherwise result from the seismic event).

In an embodiment, the beam 200 may be spaced from the column 300 by a space 30. Hence, for example, the first seismic fuse plate 410*a* and the second seismic fuse plate 410*b* may experience shear forces as the beam 200 moves toward and/or away from the column 300 during a seismic event. As described below in more detail, positioning the beam 200 spaced from the column 300 along the horizontal axis 20 (e.g., by a suitable distance) and secured to the column 300 by the beam-to-column connection system 400 may allow the beam 200 to move in a direction that is generally parallel to the horizontal axis 20 as the frame tilts. In some embodiments, the horizontal axis 20 together with the beam 200 may change orientation relative to the column 300 and relative to the vertical axis 10, as the moment-resisting frame 100 tilts during a seismic event. Furthermore, the beam 200 may apply or produce shear force on the first seismic fuse plate 410*a* and the second seismic fuse plate 410*b*, as the frame tilts and the beam 200 is forced to change orientation relative to the column 300 (e.g., from a generally perpendicular orientation to forming an acute and/or obtuse angle relative thereto).

In some embodiments, the first seismic fuse plate 410*a* and the second seismic fuse plate 410*b* may have similar or the same configurations. Hence, for the sake of simplicity, the following describes to the first seismic fuse plate 410*a*, but would be similarly applicable to the second seismic fuse plate 410*b*. For example, the seismic fuse plate 410*a* may have at least one portion that is wider than the width of the beam 200 (e.g., a portion of the seismic fuse plate 410*a* that is near the column 300 may be wider than the width of the beam 200). Moreover, in some embodiments, the first pair of splice plates 420*a* and the second pair of splice plates 420*a*' may be secured to the seismic fuse plate 410*a* at the portion that is wider than the beam 200 (e.g., the first pair of splice plates 420*a* and the second first pair of splice plates 420*a*' may be positioned about the beam 200 such as to define a distance therebetween that is greater than the width of the beam 200.

In an embodiment, at least one portion of the seismic fuse plate 410*a* may be positioned between the beam 200 and an outer periphery of the beam 200 (e.g., without contacting any other portion of the beam 200, column 300, other portions of the beam-to-column connection system 400, or combination thereof). The seismic fuse plate 410*a* may include first and second shear portions 411*a*, 411*a*'. Specifically, for example, the first shear portion 411*a* may extend between a beam-connection portion (e.g., portion of the seismic fuse plate 410*a* that may be connected to the beam 200) and a splice plate-connection portion (e.g., portion of the seismic fuse plate 410*a* that is secured between the first pair of splice plates 420*a*). Similarly, the second shear portion 411*a*' may extend between the beam-connection portion (e.g., portion of the seismic fuse plate 410*a* that may be connected to the beam 200) and another splice plate-connection portion (e.g., portion of the seismic fuse plate 410*a* that is secured between the second pair of splice plates 420*a*'). Hence, under some operating conditions, the first and second shear portions 411*a* and/or 411*a*' may fail, as the beam 200 is forced away from and/or toward the column 300.

In some embodiments, the beam-to-column connection system 400 may include a shear tab 450 (e.g., blocker plate) that connects the beam web 230 to the first column flange 310. For example, as shown in FIGS. 2A-2C, the shear tab 450 may be secured to the beam 200 (e.g., to the web of the beam 200) and may abut the column 300 (e.g., may abut the flange of the column 300). In the illustrated example, the shear tab 450 is fastened to the beam 200 with fasteners. It should be appreciated, however, that the shear tab 450 may be attached to the beam 200 with any number of suitable connections (e.g., weld, rivets, etc.).

Moreover, the shear tab 450 may be detached from the beam 200. For example, the shear tab 450 may be attached to the beam 200 after the beam 200 is positioned at the suitable location relative to the column 300 (e.g., without the shear tab 450, the beam 200 may be positioned between two opposing columns, such that the beam 200 is suitably shorter than the distance between the two opposing columns, to facilitate installation of the beam 200). Furthermore, the shear tab 450 may have horizontal slotted holes to accommodate the beam 200 from moving toward the column 300 or moving away from the column 300.

In other words, the shear tab 450 may provide additional restraint (e.g., to resist gravity loads) for the beam 200, but with limited ability to transmit movements from the beam 200 to the column 300.

In an embodiment, in a seismic event that applies lateral load onto the moment-resisting frame 100 (e.g., in directions along the axis 20), the seismic fuse plate 410*a* may experience a greater load when the beam 200 experiences forces in the direction away from the column 300 than when the beam 200 experiences forced in the direction toward the column 300. As such, under some operating conditions, the seismic fuse plate 410*a* may be more prone to failure when the beam 200 is forced away from the column 300. In other words, the beam-to-column connection system 400 may be configured such that the seismic fuse plate 410*a* may selectively plastically deform and/or fail in a single direction (e.g., due to shear forces at the first and second shear portions 411*a*, 411*a*'). As described above, in some conventional frames, the beam may be selectively weakened near the connection to the column; such weakened portion may fail in response to repeated compressive and tensile loads thereof (e.g., due to buckling).

Figure 3A:
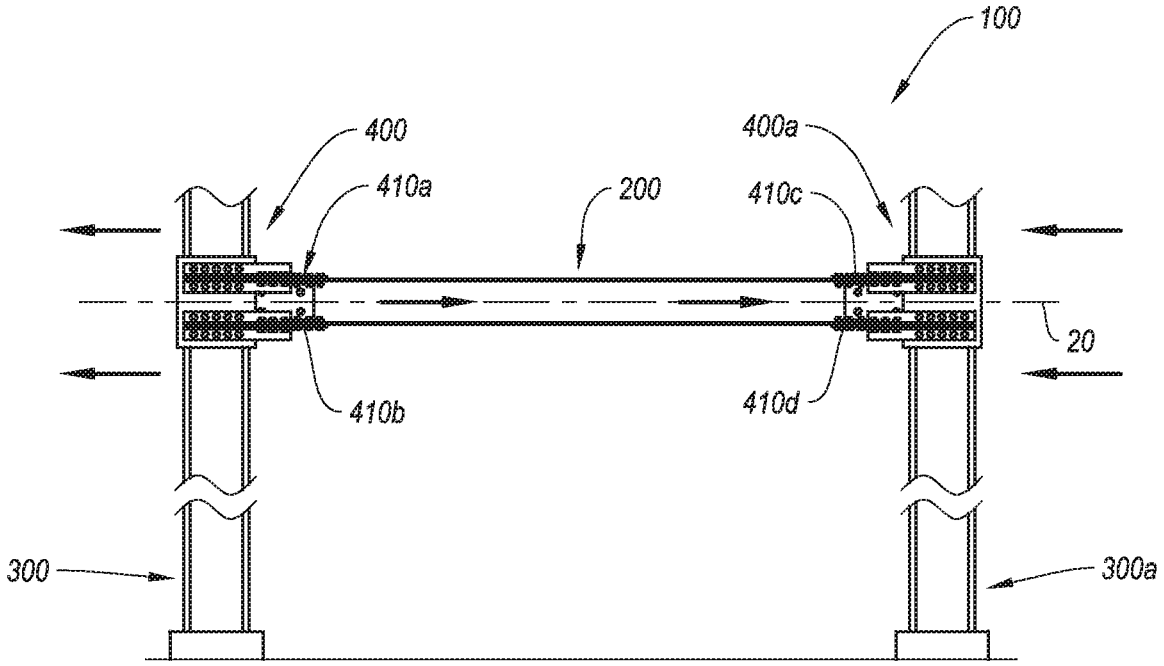
FIG. 3A is a schematic front view of the moment-resisting frame of FIG. 1 under an example load from a seismic event that delivers energy to the moment-resisting frame and causes minimal deformation of a seismic fuse plate that is included in the moment-resisting frame.
Figure 3B:
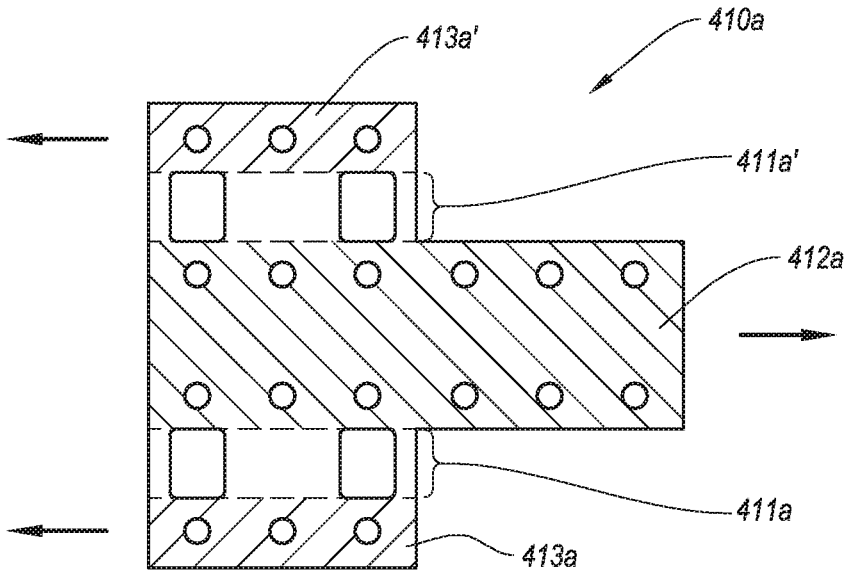
FIG. 3B is a top view of the seismic fuse plate exposed to the loads shown in FIG. 3A.

FIG. 3A is a schematic front view of the moment-resisting frame 100 under an example load from a seismic event. FIG. 3B shows the forces experienced by the seismic fuse plate

410*a* of the beam-to-column connection system 400, according to the loading shown in FIG. 3A. The moment-resisting frame 100 may experience a seismic event that may produce lateral forces that generally push the moment-resisting frame 100 laterally to the left (as shown in FIG. 3A) and/or in the opposite direction, to the right.

The moment-resisting frame 100 may include a beam 200 connected to and between opposing columns 300 and 300*a*, thereby forming a substantially rigid structure that may resist lateral forces (e.g., the moment-resisting frame 100 may be included in a structure, such as a building, and may provide suitable resistance to lateral movements, which may prevent collapse of the building under certain conditions). As described above, the beam 200 may be connected to the column 300 by the beam-to-column connection system 400. Furthermore, the beam 200 may be connected to the column 300*a* by a beam-to-column connection system 400*a* that may be similar to or the same as the beam-to-column connection system 400 (e.g., as described above).

In the illustrated example, the beam-to-column connection system 400 includes the seismic fuse plate 410*a* and seismic fuse plate 410*b* that experience shear load (as shown in FIG. 3B in connection with the 410*a*). Conversely, the beam-to-column connection system 400*a* may include seismic fuse plate 410*c* and seismic fuse plate 410*d* (that may be similar to or the same as the respective seismic fuse plate 410*a* and seismic fuse plate 410*b*), which may experience compressive load. If the beam 200 bears on the shear tab 450 horizontally (e.g., the bolts reach the end of the horizontal slots in the shear tab 450), the seismic fuse plate 410*a* and seismic fuse plate 410*b* may experience greater shear loads than the shear loads experienced by the seismic fuse plate 410*c* and seismic fuse plate 410*d*.

As described above, the seismic fuse plate 410*a* may include the shear portions 411*a*, 411*a*' that may be positioned and configured such as not to contact any other portion of the beam 200, column 300, beam-to-column connection system 400, or combinations thereof. For example, the seismic fuse plate 410*a* may include a beam-connection portion 412*a* that may generally extend along the middle of the seismic fuse plate 410*a* and may be connected to the beam. The seismic fuse plate 410*a* also may include a first splice plate-connection portion 413*a* and a second splice plate-connection portion 413*a*'. In an embodiment, the first splice plate-connection portion 413*a* may be secured to the first pair of splice plates and the second splice plate-connection portion 413*a*' may be secured to the second pair of splice plates. For ease of identification, FIG. 3B illustrates the first and second shear portions 411*a*, 411*a*' without any shading, the beam-connection portion 412*a* is shown with a first cross-hatch, and the first and second splice plate-connection portion 413*a*, 413*a*' are shown with a second cross-hatch (the cross-hatches only demarcate the respective portions and are not used to indicate a cross-section at the cross-hatched locations).

In an embodiment, the first and second shear portions 411*a*, 411*a*' may be positioned between the portions of the seismic fuse plate 410*a*, which may be secured to the beam or to the column. For example, the first shear portion 411*a* may be positioned between the beam-connection portion 412*a* (secured to the beam) and the first splice plate-connection portion 413*a* (secured to the first pair of splice plates). Likewise, the second shear portion 411*a*' may be positioned on an opposite side of the seismic fuse plate 410*a* and between the beam-connection portion 412*a* (secured to the beam) and the second splice plate-connection portion 413*a*' (secured to the second pair of splice plates).

Hence, for example, as the beam 200 and the column 300 experience forces in the opposite directions (as shown in FIGS. 3A-3B), the beam-connection portion 412*a* on the one hand and the first splice plate-connection portion 413*a* and second splice plate-connection portion 413*a*' on the other hand may experience the same forces as the beam 200 and the column 300, respectively (translated thereto through the splice plates and the beam-connection portion 412*a*). Moreover, as the first shear portion 411*a* is positioned between the beam-connection portion 412*a* and the splice plate-connection portion 413*a*, the first shear portion 411*a* may experience shear forces. Similarly, as the second shear portion 411*a*' is positioned between the beam-connection portion 412*a* and the 413*a*, the second shear portion 411*a*' may experience shear forces (e.g., which may be similar to or the same as the shear forces experienced at the first shear portion 411*a*).

Figure 4A:
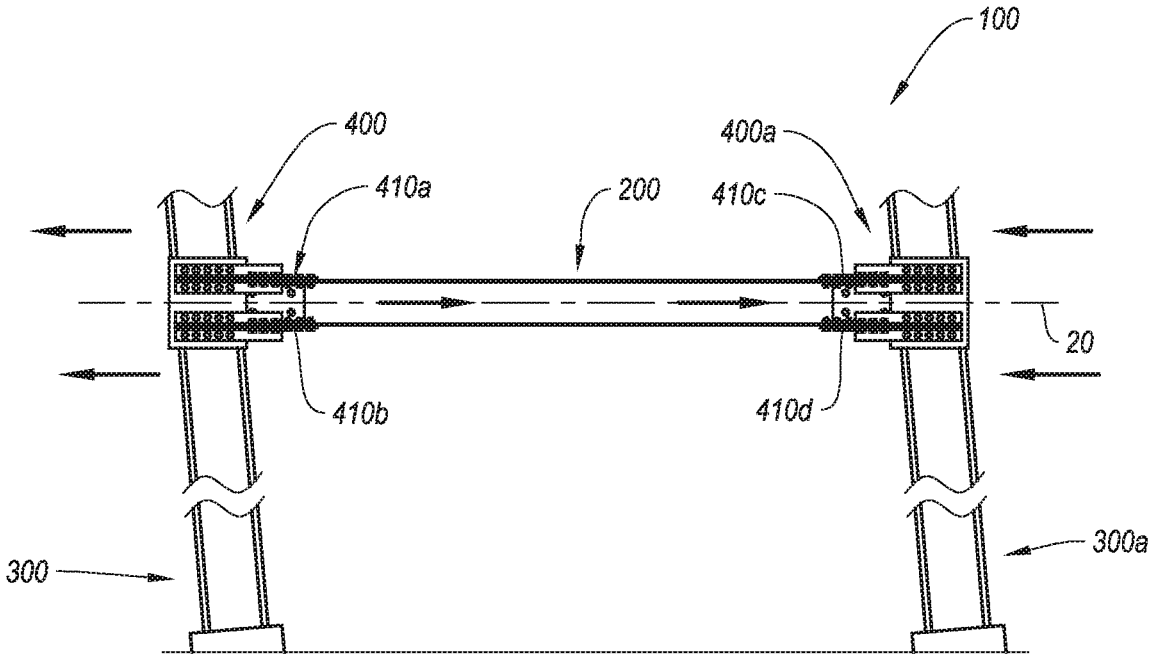
FIG. 4A is a schematic front view of the moment-resisting frame of FIG. 1 under another example load from a seismic event that delivers energy to the moment-resisting frame and causes plastic deformation or failure of a seismic fuse plate that is included in the moment-resisting frame.
Figure 4B:
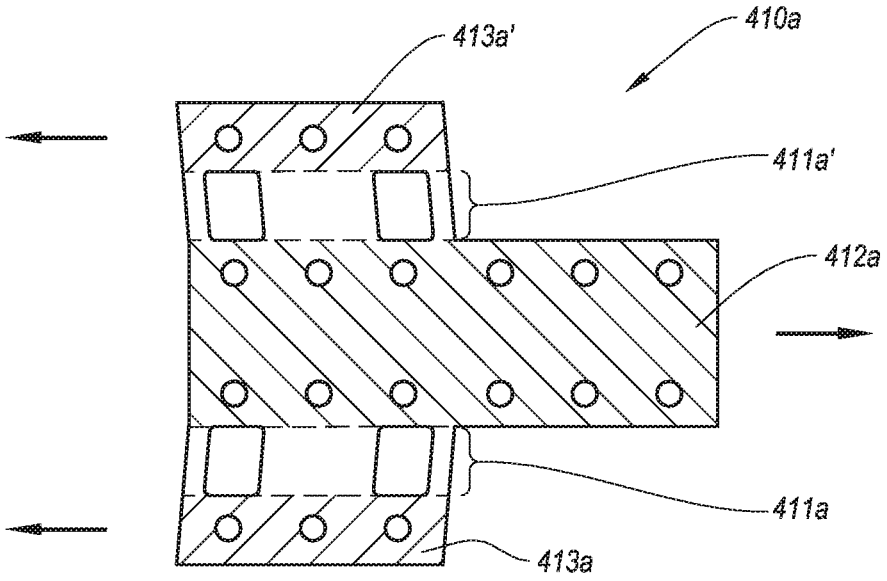
FIG. 4B is a top view of the seismic fuse plate exposed to the loads shown in FIG. 4A.

FIG. 4A is a schematic illustration that shows the moment-resisting frame 100 after the seismic fuse plate 410*a* and the seismic fuse plate 410*b* deform (e.g., plastically or elastically deform) to facilitate lateral tilting of the moment-resisting frame 100. It should be appreciated that the moment-resisting frame 100 is not shown to scale in FIG. 4A. FIG. 4B shows the deformation of the seismic fuse plate 410*a* resulting from the tilt of the moment-resisting frame 100 shown in FIG. 4A. In particular, as shown in FIG. 4B, the first and second shear portions 411*a*, 411*a*' may be deformed (plastically or elastically) due to the shear stress experienced thereat.

Generally, the amount of deformation and/or the forces required to produce the deformation (e.g., such as to plastically deform or fail at least one of the first or second shear portion 411*a*, 411*a*' of the seismic fuse plate 410*a* and/or corresponding portions of the seismic fuse plate 410*b*) may vary from one embodiment to the next and may depend on the shape and size of the first and second shear portions 411*a*, 411*a*', modulus of elasticity of the material of the seismic fuse plate 410 and/or material of the first and second shear portions 411*a*, 411*a*', etc.

As described above, in some embodiment, the moment-resisting frame may have two or more beam-to-column connection systems that include at least one seismic fuse plate (e.g., two opposing beam-to-column connection systems). Additionally or alternatively, moment-resisting frames may include a single beam-to-column connection system with at least one seismic fuse plate. For example, a moment-resisting frame may include two opposing columns and a beam connected thereto; a beam-to-column connection system (e.g., as described above) may connect the beam to a first column, and another connection (e.g., another rigid connection, such as a welded connection) may connect the beam to a second column.

Figure 5:
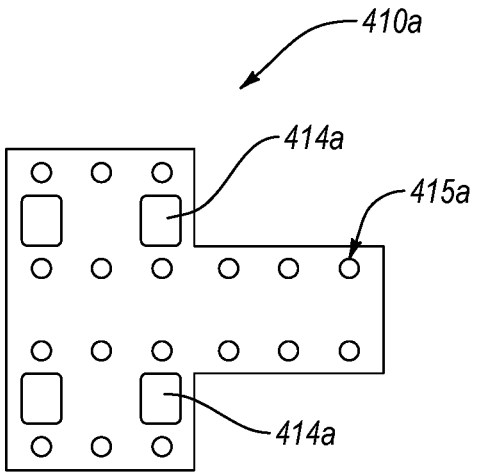
FIG. 5 is a top view of a seismic fuse plate, according to an embodiment.

The seismic fuse plate 410*a* may have a plate-like configuration of a selected thickness. For example, the thickness of the seismic fuse plate 410*a* may be selected such that the first and second shear portions 411*a*, 411*a*' have a suitable or selected failure point or force at which the first and second shear portions 411*a*, 411*a*' plastically deform. FIG. 5 is a top view of the seismic fuse plate 410*a* according to an embodiment. As shown in FIG. 5 the seismic fuse plate 410*a* may have openings 414*a* extending through the thickness of the seismic fuse plate 410*a*. In particular, for example, the openings 414*a* may weaken the first and second shear portions 411*a*, 411*a*', such that the first and second shear portions 411*a*, 411*a*' have suitable strength (e.g., such that the first and second shear portions 411*a*, 411*a*' may deform to absorb energy of a seismic event and prevent deformation or damage to the beam and/or column connected thereby). In some embodiments, the shear portions may have other suitable shapes and sizes, as described below.

Also, as described above, the seismic fuse plate 410*a* may be fastened to the beam and to the splice plates. Hence, for example, the seismic fuse plate 410*a* may include fastener holes 415*a* at suitable locations for fastening the seismic fuse plate 410*a*. Generally, however, the seismic fuse plate 410*a* may be fastened to the beam and to the splice plates with any number of suitable connections (e.g., weld, rivets, etc.). In some embodiments, the seismic fuse plate may have no holes or openings for fasteners.

Figure 6:
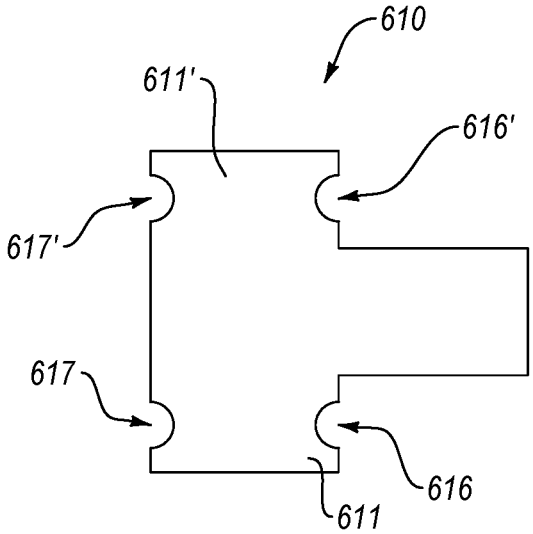
FIG. 6 is a top view of a seismic fuse plate, according to another embodiment.

It should be appreciated, however, that the shear portions of the seismic fuse plate may have any number of suitable configurations. FIG. 6 is a top view of a seismic fuse plate 610 according to an embodiment. Except as otherwise described herein, the seismic fuse plate 610 may be similar to or the same seismic fuse plate 410 (FIG. 5) and may be used in any of the beam-to-column connection systems disclosed herein. For example, the seismic fuse plate 610 may include first and second shear portions 611 and 611' that may be defined by one or more cutouts extending from the edges of the seismic fuse plate 610 (e.g., by the cutouts 616, 617 and cutouts 616', 617', respectively).

Figure 7A:
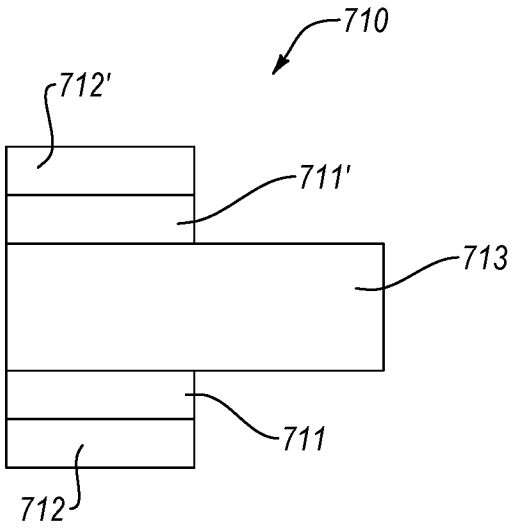
FIG. 7A is a top view of a seismic fuse plate, according to yet another embodiment.
Figure 7B:
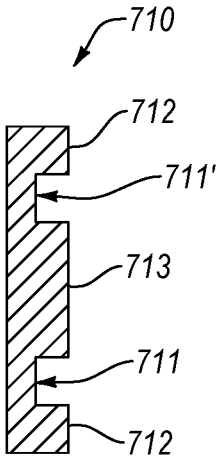
FIG. 7B is a cross-sectional view of the seismic fuse plate of FIG. 7A.

Moreover, in some embodiments, the shear portions may have a smaller thickness than other portions of the seismic fuse plate. FIG. 7A is a top view of a seismic fuse plate 710 according to an embodiment. FIG. 7B is a cross-sectional view of the seismic fuse plate 710, as indicated in FIG. 7A. Except as otherwise described herein, the seismic fuse plate 710 may be similar to or the same any of the seismic fuse plates 410*a*, 610 (FIGS. 5-6) and may be used in any of the beam-to-column connection systems disclosed herein. For example, the seismic fuse plate 710 may include first and second shear portions 711, 711' that may have one or more portions with smaller thicknesses than beam-connection portion 712 and/or first and second splice plate-connection portions 713, 713'.

Furthermore, the seismic fuse plate may have any number of suitable configurations. In an embodiment, where the shear portions 711, 711' of the seismic fuse plate 710 may have selected strength, such as to produce a controlled plastic deformation and/or failure thereat. For example, the shear portions 711, 711' may have a suitable or selected thickness, such that the shear portions 711, 711' may deform or fail in response to selected shear forces applied thereto.

Figure 8:
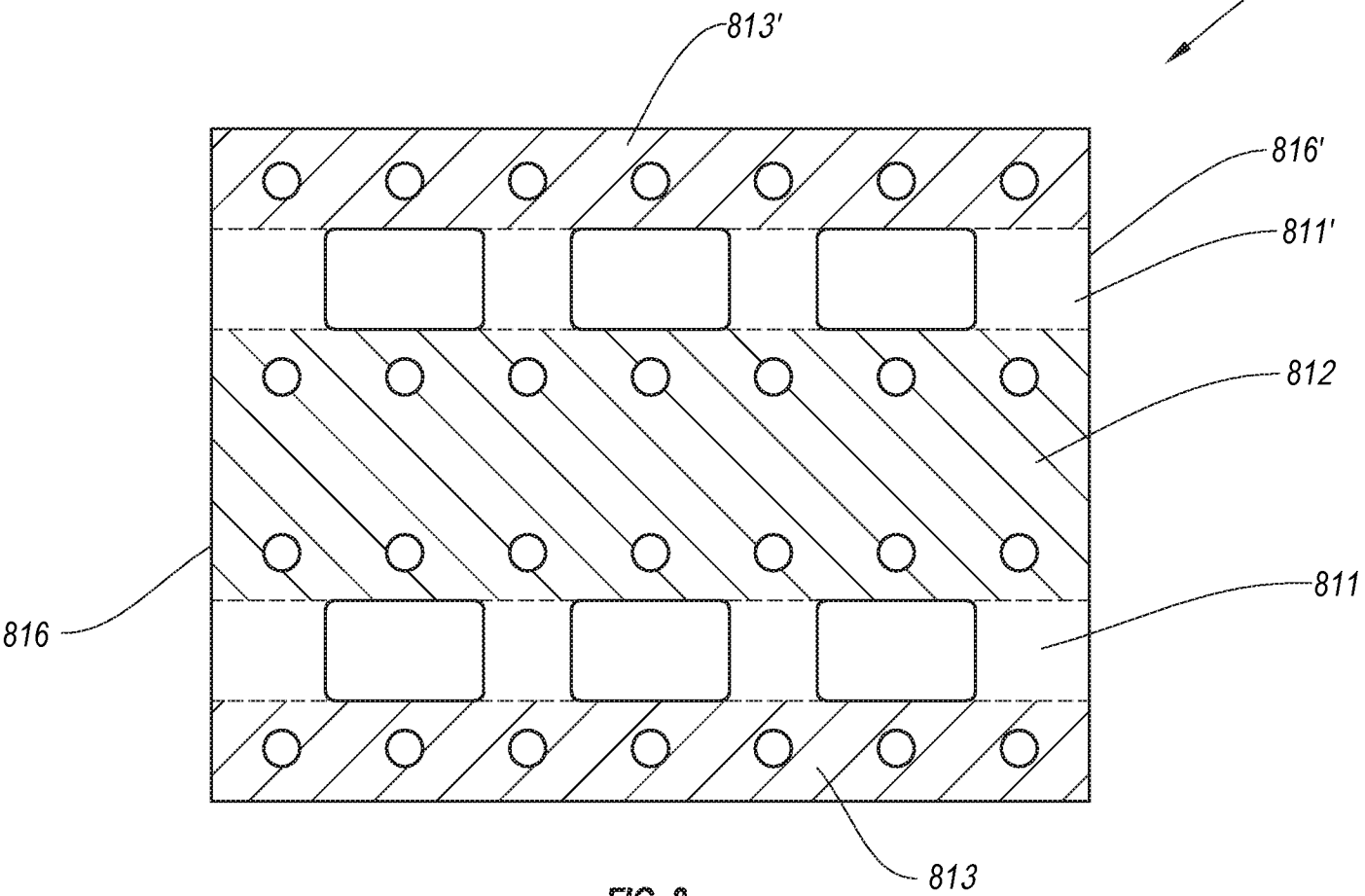
FIG. 8 is a top view of a seismic fuse plate, according to another embodiment.

FIG. 8 is a top view of a seismic fuse plate 810, according to an embodiment. Except as otherwise described herein, the seismic fuse plate 810 may be similar to or the same as any of the seismic fuse plates 410*a*, 610, 710 (FIGS. 5-7B). For example, the seismic fuse plate 810 may have first and second shear portions 811, 811', a beam-connection portion 812, and first and second splice plate-connection portions 813, 813', which may be similar to the respective first and second shear portions 411*a*, 411*a'*, a beam-connection portion 412*a*, and first and second splice plate-connection portions 413*a*, 413*a'* of the seismic fuse plate 400*a* (FIG. 3B). In the illustrated example, the first and second shear portions 811, 811', the beam-connection portion 812, and first and second splice plate-connection portions 813, 813' may have generally the same lengths (e.g., may extend between opposing edges 816, 816' of the seismic fuse plate 810). Moreover, it should be appreciated that the first and second shear portions 811, 811', the beam-connection portion 812, and first and second splice plate-connection portions 813, 813' may have any suitable widths (e.g., dimensions or sized that are generally perpendicular to the respective lengths). For example, the width of the beam-connection portion 812 may be generally the same as the width of one or more flanges of a beam. Moreover, the first and second shear portions 811, 811', the beam-connection portion 812, and first and second splice plate-connection portions 813, 813' may have substantially the same widths as one another or different widths.

In the illustrated embodiments in FIGS. 2A-8, the first and second seismic fuse plates (e.g., the first and second seismic plates 410*a*, 410*b* shown in FIGS. 2A-2B) include at least one shear portion (e.g., opening, cutout, or thinned region). However, in other embodiments, one or both of the first or second seismic fuse plates of any of the moment-resistant frames and beam-to-column connection systems may lack the shear portions and may be generally imperforate.

Figure 9A:
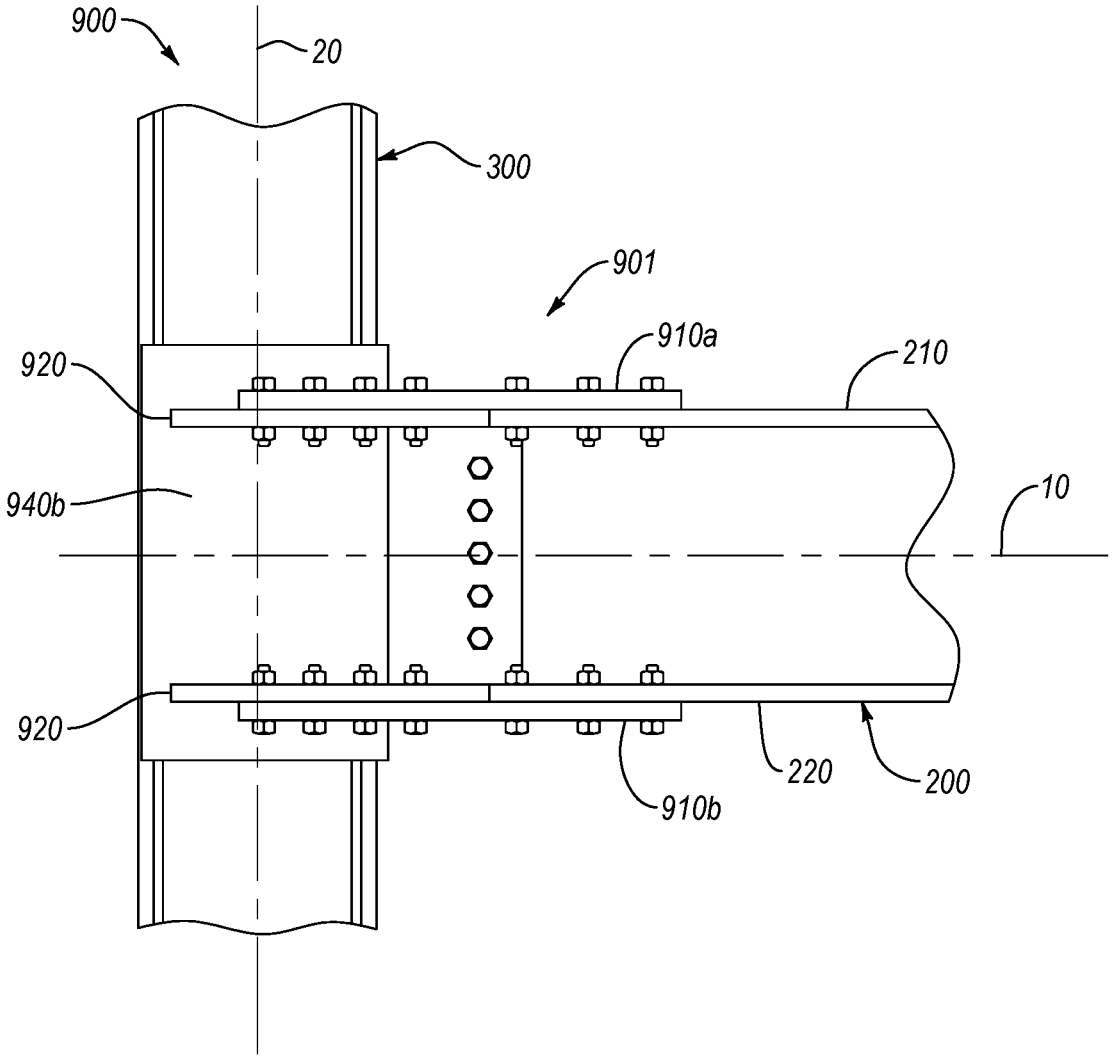
FIGS. 9A-9C are partial side elevational, top plan, and bottom plan views, respectively, of a moment-resisting frame, according to an embodiment.
Figure 9B:
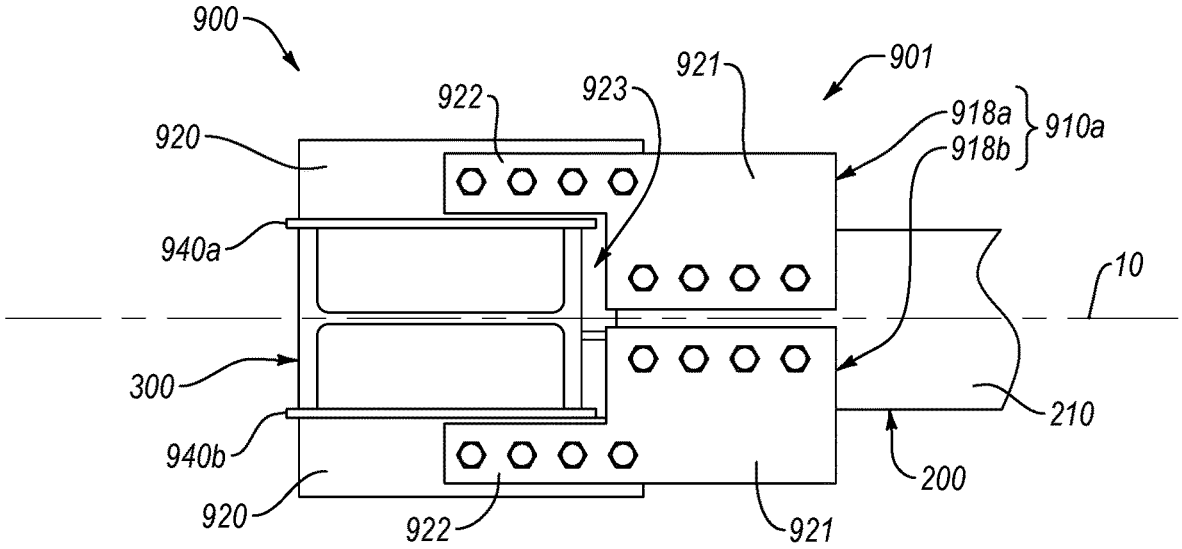
Figure 9C:
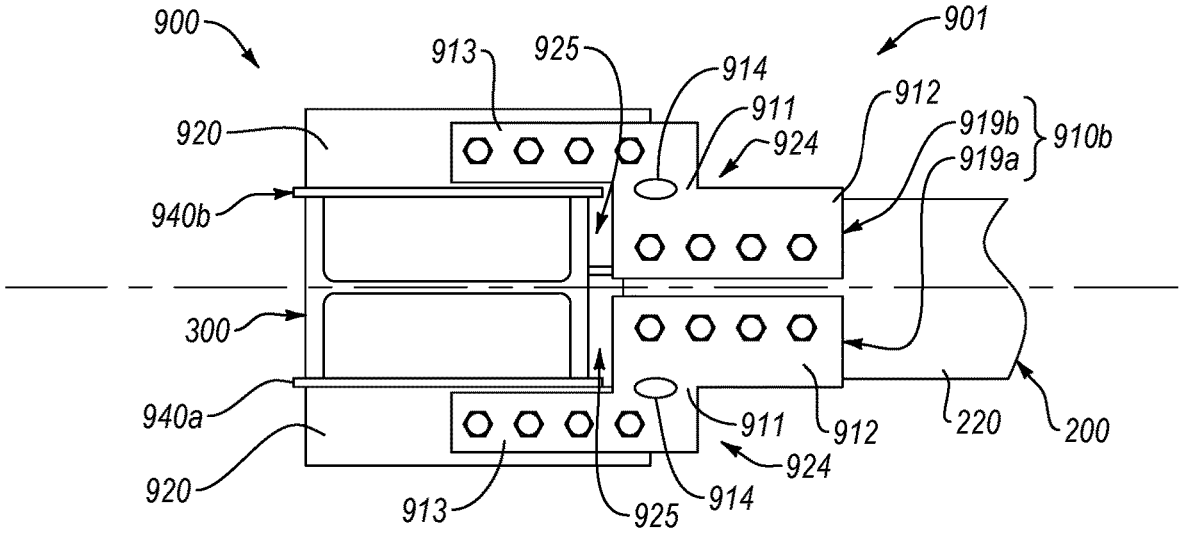

FIGS. 9A-9C are partial side elevational, top plan, and bottom plan views, respectively, of a moment-resisting frame 900, according to an embodiment. Except as otherwise disclosed herein, the moment-resisting frame 900 is the same as or substantially similar to any of the moment-resisting frames disclosed herein. For example, the moment-resisting frame 900 includes a beam 200, a column 300, and a beam-to-column connection system 901. The beam-to-column connection system 901 includes a plurality of splice plates 920 (e.g., a first, second, third, and fourth splice plates), a first doubler plate 940*a*, and a second doubler plate 944*b*.

Referring to FIG. 9B, the beam-to-column connection system 901 include a plate 910*a*. The plate 910*a* includes a first piece 918*a* and a second piece 918*b* that is distinct from the first piece 918*a*. The first piece 918*a* is configured to connect to a first side of the top flange 210 (e.g., left side of the top flange 210) and connect to the first doubler plate 940*a* indirectly via one of the plurality of splice plates. The second piece 918*b* is connected to a second side of the top flange 210 that is opposite the first side (e.g., the right side of the top flange 210) and connect to the second double plate 940*b* indirectly via another one of the plurality of splice plates 920. Forming the plate 910*a* from the first and second pieces 918*b*, 918*b* may facilitate repair of the plate 910*a* when the plate 910*a* fails. For example, only one of the first piece 918*a* or the second piece 918*b* may fail during a seismic event. In such an example, only one of the first or second piece 918*a*, 918*b* needs to be repaired while the other of the first or second piece 918*a*, 918*b* may remain connected to the column 300 and the corresponding doubler plate. However, it is noted that the plate 910*a* may exhibit a single pieces construction, as previously disclosed herein.

In an embodiment, each of the first and second pieces 918*a*, 918*b* of the plate 910*a* includes a first portion 921 and a second portion 922 extending from the first portion 921. The first and second portions 921, 922 may exhibit a generally rectangular shape. However, the first and second portions 921, 922 may exhibit other non-rectangular shapes if suitable. The first and second portions 921, 922 may be arranged relative to each other such that the first and second pieces 918*a*, 918*b* exhibit a generally L-like shape. Further, the generally L-shape of the first and second pieces 918*a*, 918*b* allows the first and second pieces 918*a*, 918*b* to be coupled to a greater percentage of the splice plates 920 and/or allow the splice plates 920 to exhibit a shorter length than if the first and second pieces 918*a*, 918*b* exhibited a different shape. The first portion 921 exhibits a first width (measured perpendicularly from the horizontal and vertical axes 10, 20) and the second section 922 exhibits a second width that is measured parallel to the first width. The first width is greater than the second width. The different widths of the first and second portions 921, 922 forms a first exterior recess 923. The first exterior recesses 923 of the first and second pieces 918*a*, 918*b*, collectively, may be sized and configured to accommodate a portion of the column 300 therein, as shown in FIG. 9B. In an embodiment, the first and second pieces 918*a*, 918*b* may exhibit any other suitable shape. For example, any of the seismic fuse plates disclosed herein may be separated into a first and second pieces.

At least a portion of the first portions 921 of the first and second pieces 918*a*, 918*b* form the beam-connection portion of the plate 910*a* and at least a portion of the second portions 922 of the first and second pieces 918*a*, 918*b* form the splice plate-connection portion of the plate 910*a*. The first portions 921 of the first and second pieces 918*a*, 918*b* may also form part of the beam-connection portion of the plate 910*a*.

In an embodiment, the plate 910*a* (e.g., the first and second pieces 918*a*, 918*b*) does not include a shear portion. In such an embodiment, the plate 910*a* does not include at least one of an opening (e.g., opening 414*a* of FIG. 5), cutout (e.g., cutout 616 of FIG. 6), or smaller thicknesses (e.g., similar to shear portions 711, 711' of FIGS. 7A-7B). As such, the plate 910*a* are stronger and less likely to fail than seismic fuse plates that include shear portions. In other words, the plate 910*a* is not designed to yield. It is noted that any of the fuse plates disclosed herein can be replaced with substantially similar plates that do not include a shear portion. In an embodiment, the plate 910*a* (e.g., at least one of the first or second piece 918*a*, 918*b*) may include a shear portion. In such an embodiment, the plate 910*a* is a seismic fuse plate.

Referring to FIG. 9C, the beam-to-column connection system 901 includes a seismic fuse plate 910*b* includes a third piece 919*a* and a fourth piece 919*b* that is distinct from the third piece 919*a*. The third piece 919*a* is configured to connect to a first side of the bottom flange 220 and connect to the first doubler plate 940*a* indirectly via at least one of the plurality of splice plates 920 that are not connected to the plate 910*a*. The fourth piece 919*b* is connected to a second opposing side of the bottom flange 220 and connect to the second double plate 940*b* indirectly via a remainder of the plurality of splice plates 920. Forming the seismic fuse plate 910*b* from the third and fourth pieces 919*b*, 919*b* may facilitate repair of the seismic fuse plate 910*b* when the seismic fuse plate 910*b* fails. For example, only one of the third piece 919*a* or the fourth pieces 919*b* may fail during a seismic event. In such an example, only one of the third or fourth piece 919*a*, 919*b* needs to be repaired while the other of the third or fourth piece 919*a*, 919*b* may remain connected to the column 300 and the corresponding doubler plate. However, it is noted that the seismic fuse plate 910*b* may exhibit a single piece construction, as previously disclosed herein.

In an embodiment, each of the third and fourth pieces 919*a*, 919*b* of the seismic fuse plate 910*b* includes a beam-connection portion 912, a splice plate-connection portion 913, and a shear portion 911 extending between the beam-connection portion 912 and the splice plate-connection portion 913. The beam-connection portion 912, the splice plate-plate connection portion 913, and the shear portion 911 may each exhibit a generally rectangular shape. The dimensions of the generally rectangular shape of at least two of the beam-connection portion 912, the splice plate-plate connection portion 913, or the shear portion 911 may be the same or different. The beam-connection portion 912, the splice plate-plate connection portion 913, and the shear portion 911 may be arranged relative to each other such that the third and fourth pieces 919*a*, 919*b* exhibit an angular generally S-shape, as shown in FIG. 9C. The generally S-shape of the third and fourth pieces 919*a*, 919*b* allows the beam-connection portion 912 and the shear portion 911 form a second exterior recess 924 and the splice plate-connection portion 913 and shear portion 911 form a third exterior recess 925. The second exterior recesses 925 may cause the third and/or fourth pieces 919*a*, 919*b* to preferentially yield at the shear portions 911 thereof. The third exterior recesses 925 of the third and fourth pieces 919*a*, 919*b*, collectively, may be size and configured to accommodate at least a portion of the column 300, as shown in FIG. 9C.

Further, the generally S-shape of the third and fourth pieces 919*a*, 919*b* allows the third and fourth pieces 919*a*, 919*b* to be coupled to a greater percentage of the splice plates 920 and/or allow the splice plates 920 to exhibit a shorter length than if the third and fourth pieces 919*a*, 919*b* exhibited a different shape. In an embodiment, the third and fourth pieces 919*a*, 919*b* may exhibit any other suitable shape. For example, the third and fourth pieces 919*a*, 919*b* can, collectively, exhibit any of the shapes disclosed herein.

Figure 9D:
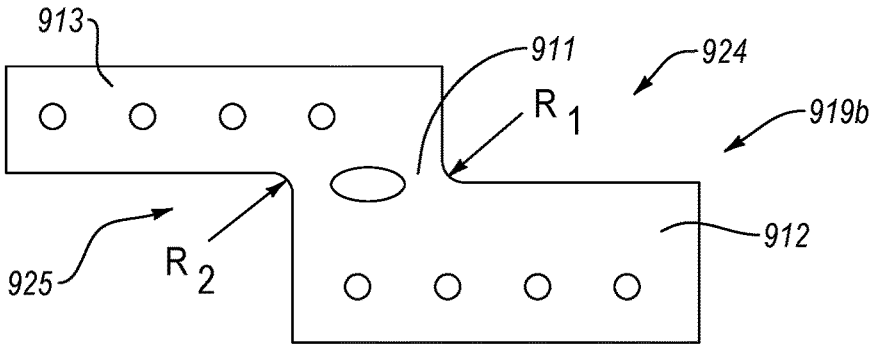
FIG. 9D is a top plan view of one of the third or fourth piece shown in FIGS. 9A-9C, according to an embodiment.

FIG. 9D is a top plan view of one of the third or fourth piece 919*a*, 919*b*, according to an embodiment. In some embodiments, the third and fourth pieces 919*a*, 919*b* may have similar or the same configurations. Hence, for the sake of simplicity, the following describes to the fourth piece 919*b*, but would be similarly applicable to the third piece 919*a*. The second and third exterior recesses 924, 925 of the fourth piece 919*b* may defined a concave corner exhibiting a radius R1 and R2, respectively. It has been found that increasing the radiuses R1 and R2 may increase the yield resistance of the seismic fuse plate 910*b*. However, the radius R2 of the third exterior recess 925 may be limited by the need to partially position the column 300 in the first exterior recess 923 whereas there is no such limit for the radius R1. As such, in an example, the radius R1 may be greater than the radius R2. In an example, the radiuses R1 and R2 can be about 10 μm to about 1 m, such as in ranges of about 10 μm to about 100 μm, about 50 μm to about 500 μm, about 100 μm to about 1 mm, about 500 μm to about 2 mm, about 1 mm to about 5 mm, about 2 mm to about 7.5 mm, about 5 mm to about 10 mm, about 7.5 mm to about 15 mm, about 10 mm to about 25 mm, about 20 mm to about 40 mm, about 30 mm to about 50 mm, about 40 mm to about 60 mm, about 50 mm to about 70 mm, about 60 mm to about 80 mm, about 75 mm to about 100 mm, about 80 mm to about 125 mm, about 100 mm to about 150 mm, about 125 mm to about 175 mm, about 150 mm to about 200 mm, about 175 mm to about 250 mm, about 200 mm to about 300 mm, about 250 mm to about 400 mm, about 350 mm to about 500 mm, about 450 mm to about 750 mm, or about 600 mm to about 1 m.

In an embodiment, the third and fourth pieces 919*a*, 919*b* include an opening 914. For example, the opening 914 may be formed in the shear portion 911 of the third and fourth pieces 919*a*, 919*b*. However, it is noted that at least one of the third or fourth pieces 919*a*, 919*b* may include at least one cutout (e.g., similar to cutout 616 of FIG. 6) or a smaller thickness (e.g., similar to the shear portion 711, 711' of FIGS. 7A-7B) instead of or in addition to the opening 914. The presence of the opening 914 and/or the second and third exterior recesses 924, 925 may cause the seismic fuse plate 910*b* to preferentially yield relative to the plate 910*a*. Allowing the seismic fuse plate 910*b* to preferentially yield during a seismic event may allow the plate 910*a* to secure the beam 200 to the column 300 after the seismic fuse plate 910*b* fails and may allow for greater movement in the beam-to-column connection system 901 before the entire beam-to-column connection system 901 fails. Further, configuring the seismic fuse plate 910*b* to preferentially yield relative to the plate 910*a* may facilitate repair of the beam-to-column connection system 901. For example, typically, the bottom flange 220 of the beam 200 is more easily accessible than the top flange 210 of the beam 200 since, in most buildings, the ceiling (which may provide access to the bottom flange 220) is more easily removed than a floor (which may provide access to the top flange 210). As such, the seismic fuse plate 910*b* is typically coupled to the bottom flange 220 since such positioning may facilitate repair of the seismic fuse plate 910*b*. However, in examples when the top flange 210 is more accessible than the bottom flange 220, the seismic fuse plate 910*b* may be coupled to the top flange 210 to facilitate repair of the seismic fuse plate 910*b*.

As previously discussed, the beam-to-column connection system 901 also includes a plurality of splice plates 920 (e.g., at least four splice plates 920) that are configured to couple the plate 910*a* and the seismic fuse plate 910*b* to the doubler plates 940*a*, 940*b*.

In an embodiment, at least some of the plurality of splice plates 920 may be configured to operate in pairs, wherein each pair of the splice plates 920 is configured to sandwich and be attached to the same splice plate-connection portion. In an embodiment, at least one of the plurality of splice plates 920 may be configured to be attached to a splice plate-connection portion by itself which may facilitate assembly of the beam-to-column connection system 901.

Each of the plurality of splice plates 920 may be configured to be coupled to the doubler plates 940*a*, 940*b* and to the plate 910*a* and the seismic fuse plate 910*b* using any of the attachment methods disclosed herein. In an embodiment, at least one of the plurality of splice plates 920 may be welded to a corresponding one of the first or second doubler plate 940*a*, 940*b* because welding the splice plates 920 to the corresponding one of the first or second doubler plate 940*a*, 940*b* off-site, instead of on a construction site, may be performed more efficiently and accurately. In an embodiment, at least one of the plurality of splice plates 920 may be configured to be coupled to the plate 910*a* and the seismic fuse plate 910*b* using any of the attachment methods disclosed herein, such as bolts, rivets, or the like.

The plurality of splice plates 920 may exhibit any suitable shape. In an embodiment, at least one of the plurality of splice plates 920 may exhibit a sheet-like shape that is bent at a right angle, similar to the splice plates illustrated in FIGS. 1-2C. In an embodiment, as illustrated, at least one of the plurality of splice plates 920 may exhibit a sheet-like shape that is substantially planar (e.g., is not bent and/or exhibits a bar-like shape). In such an embodiment, the splice plate 920 exhibiting the sheet-like shape that is substantially may still exhibit good resistance to bending when the splice plate 920 is welded to the corresponding doubler plate.

Figure 10A:
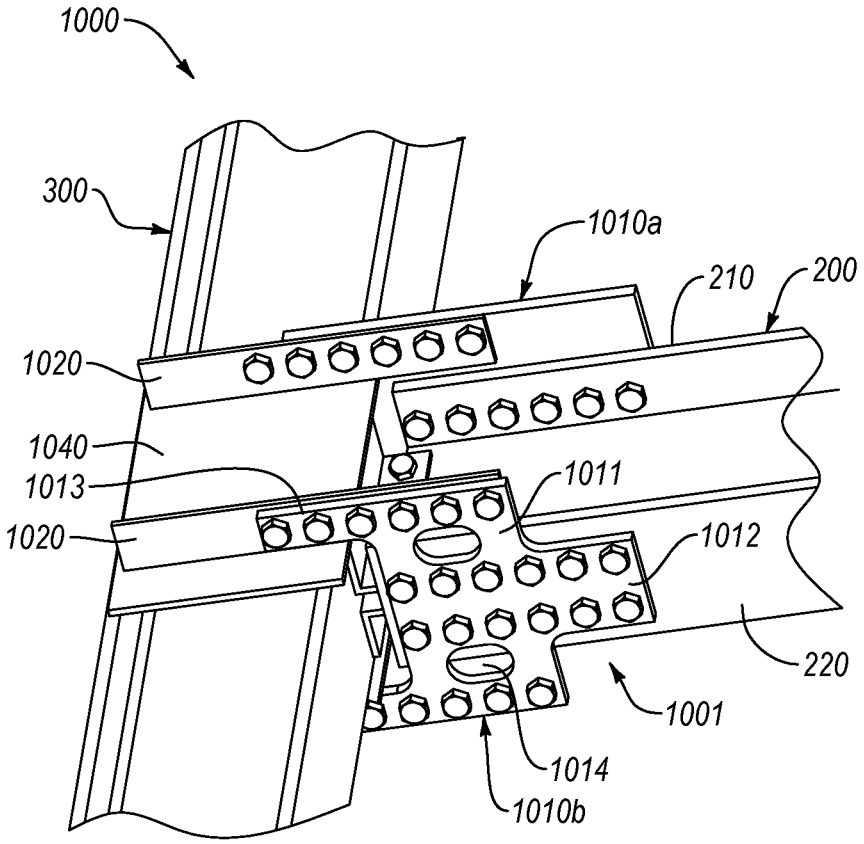
FIG. 10A is a partial isometric view of a moment-resisting frame, according to an embodiment.

FIG. 10A is a partial isometric view of a moment-resisting frame 1000, according to an embodiment. Except as otherwise shown herein, the moment-resisting frame 1000 is the same as or substantially similar to any of the moment-resisting frames disclosed herein. For example, the moment-resisting frame 1000 includes a beam 200, a column 300, and a beam-to-column connection system 1001. The beam-to-column connection system 1001 includes a plate 1010*a* (e.g., a plate that includes or does not include at least one shear portion) coupled to a top flange 210 of the beam 200, a seismic fuse plate 1010*b* coupled to a bottom flange 220 of the beam 200, a plurality of splice plates 1020, and one or more doubler plates 1040.

Figure 10B:
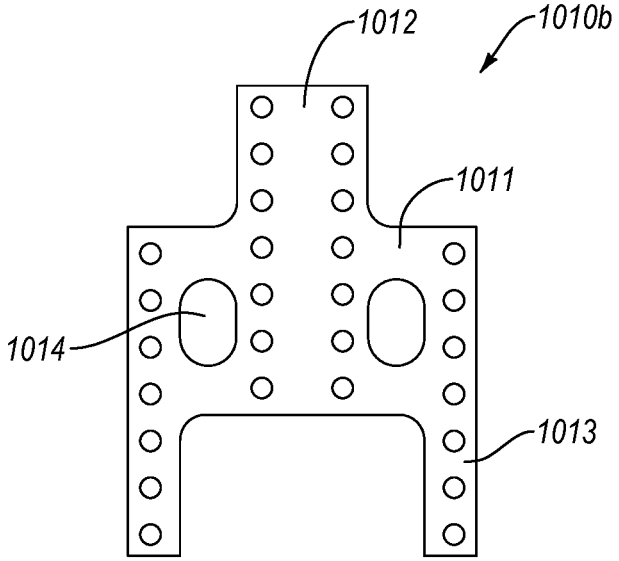
FIG. 10B is a plan view of the second seismic fuse plate shown in FIG. 10A, according to an embodiment.

FIG. 10B is a plan view of the seismic fuse plate 1010*b* shown in FIG. 10A, according to an embodiment. The seismic fuse plate 1010*b* may be substantially similar to the seismic fuse plate 910*b* of FIGS. 9C-9D except that the seismic fuse plate 1010*b* exhibits single piece construction. The seismic fuse plate 1010*b* includes two shear portions 1011, a beam-connection portion 1012, and two splice plate-connection portions 1013. Each of the shear portions 1011 may extend between the beam-connection portion 1012 and a corresponding one of the splice plate-connection portions 1013. Each of the two shear portions 1011, the beam-connection portion 1012, and the two splice plate-connection portions 1013 may exhibit a generally rectangular shape. The dimensions of at least two of the two shear portions 1011, the beam-connection portion 1012, and the two splice plate-connection portions 1013 may be the same or different. The two shear portions 1011, the beam-connection portion 1012, and the two splice plate-connection portions 1013 may be arranged, relative to each other, in a generally angular V-shape where the beam-connection portion 1012 extends from the two shear portions 1011 in a first direction and the two splice plate-connection portions 1013 extends from the two shear portions 1011 in a second direction that is opposite the first direction. The space between the two splice plate-connection portions 1013 may be selected to at least partially receive the beam 200.

In an embodiment, the two shear portions 1011 of the seismic fuse plate 1010*b* may define one or more openings 1014 In an embodiment, the seismic fuse plate 1010*b* includes a cutout (e.g., similar to the cutout 616 of FIG. 6) or a smaller thickness (e.g., similar to the shear portion 711, 711' of FIGS. 7A-7B) instead of or in addition to the opening 1014.

Figure 11A:
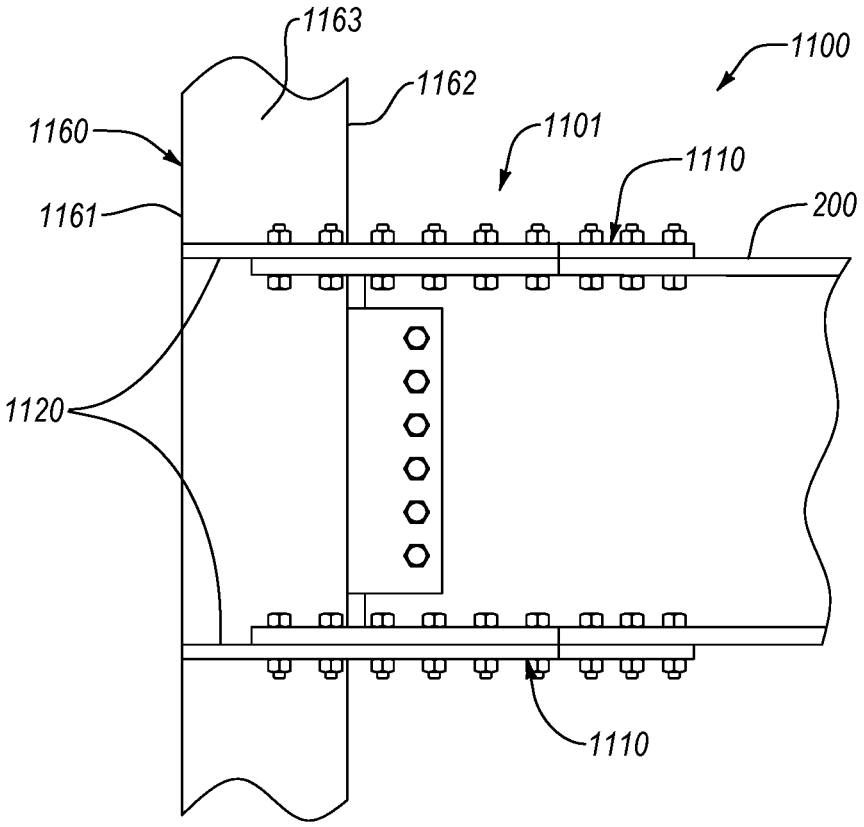
FIGS. 11A and 11B are partial front and top views, respectively, of a moment-resisting frame including a column that is a box column or a hollow structural section, according to an embodiment.
Figure 11B:
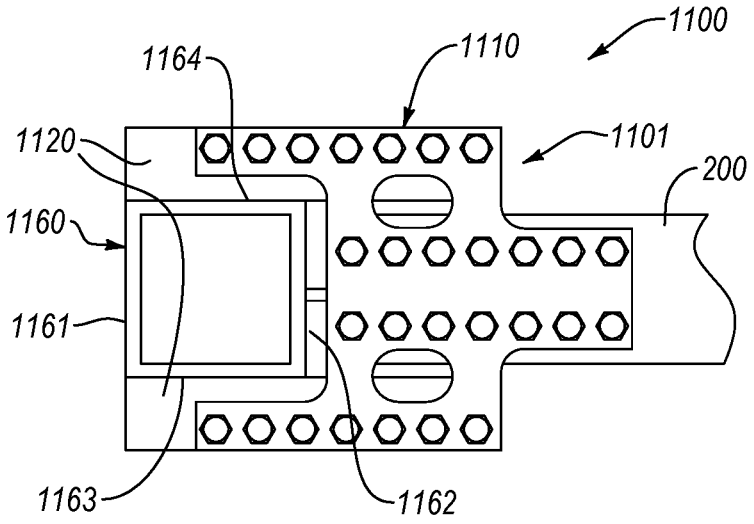

The moment-resisting frames 100, 900, and 1000 shown in FIGS. 1-3A, 4A, and 9A-10B include columns 200 that are configured as I-beams. However, the columns disclose herein can include other types of structural columns. For example, the columns disclosed herein can include a channel column, an angle column, a structural tee, a hollow structural section (e.g., exhibiting a circular, square, or rectangular cross-section), a box column exhibiting a square or rectangular cross-section (e.g., a built-up box column), bars, plates, or any other suitable type of beam. FIGS. 11A and 11B are partial front and top views, respectively, of a moment-resisting frame 1100 including a column 1160 that is box column or a hollow structural section, according to an embodiment. Except as otherwise disclosed herein, the moment-resisting frame 1100 can be the same as or substantially similar to any of the moment-resisting frames disclosed herein. For example, the moment-resisting frame 1100 can include a beam-to-column connection system 1101 that is configured to connect a column 1160 to a beam 200. The beam-to-column connection system 1100 includes at least one plate 1110 (e.g., a plate that includes or does not include at least one shear portion) and a plurality of splice plates 1120.

In an embodiment, the column 1160 is a box column or a hollow structural section exhibiting a rectangular cross-section, such as a generally square cross-section. However, it is noted that the column 1160 can include another suitable type of structural column. The column 1160 includes a first member 1161 (e.g., a first flange), a second member 1162 (e.g., a second flange) opposing the first member 1161, a third member 1163 extending between the first and second members 1161, 1162, and a fourth member 1164 opposing the third member 1163 and extending between the first and second members 1161, 1162. The third and fourth members 1163, 1164 of the column 1160 provide a surface to which the splice plates 1120 can be coupled. As such, the beam-to-column connection system 1100 may not include exterior doubler plates since the splice plates 1120 can be coupled to the third and fourth members 1163, 1164. In other words, the third and fourth members 1163, 1164 can function as exterior doubler plates that extend along an entirety of a length of the column 1160.

Figure 12A:
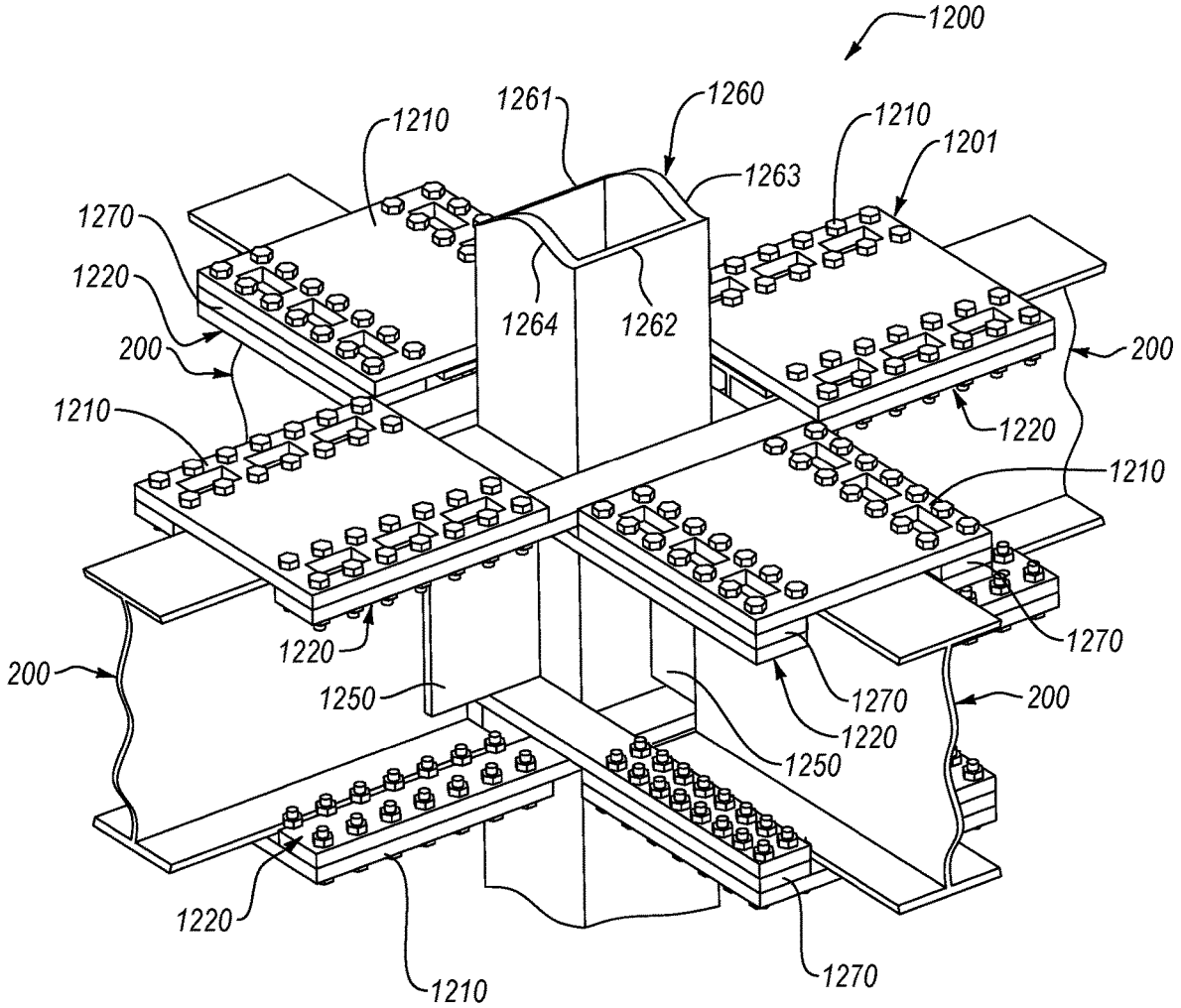
FIG. 12A is an isometric view of a moment-resisting frame that includes a plurality of beams coupled to a column, according to an embodiment.
Figure 12B:
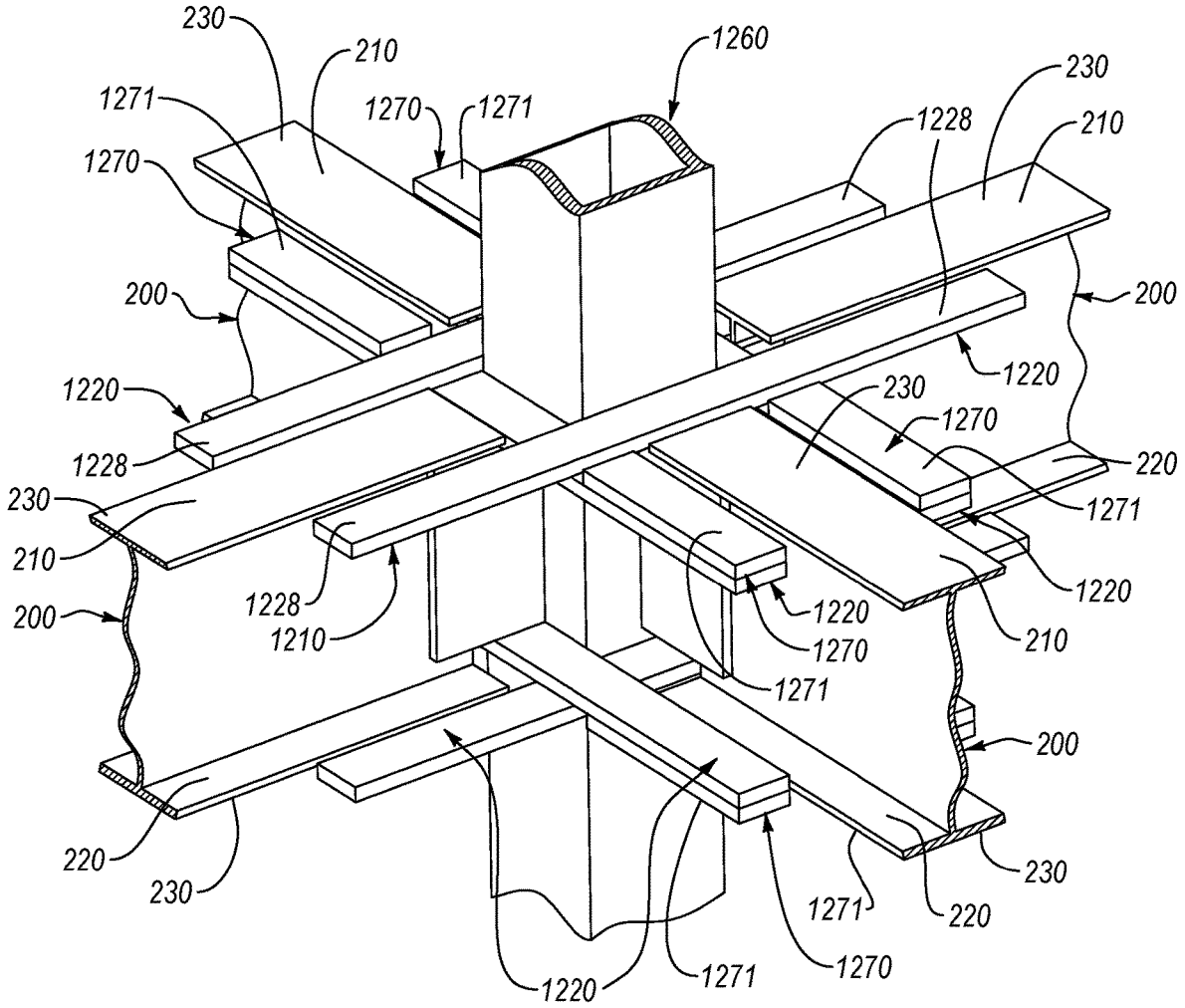
FIGS. 12B and 12C are isometric views of the moment-resisting frame shown in FIG. 12A with certain components removed for ease of understanding.
Figure 12C:
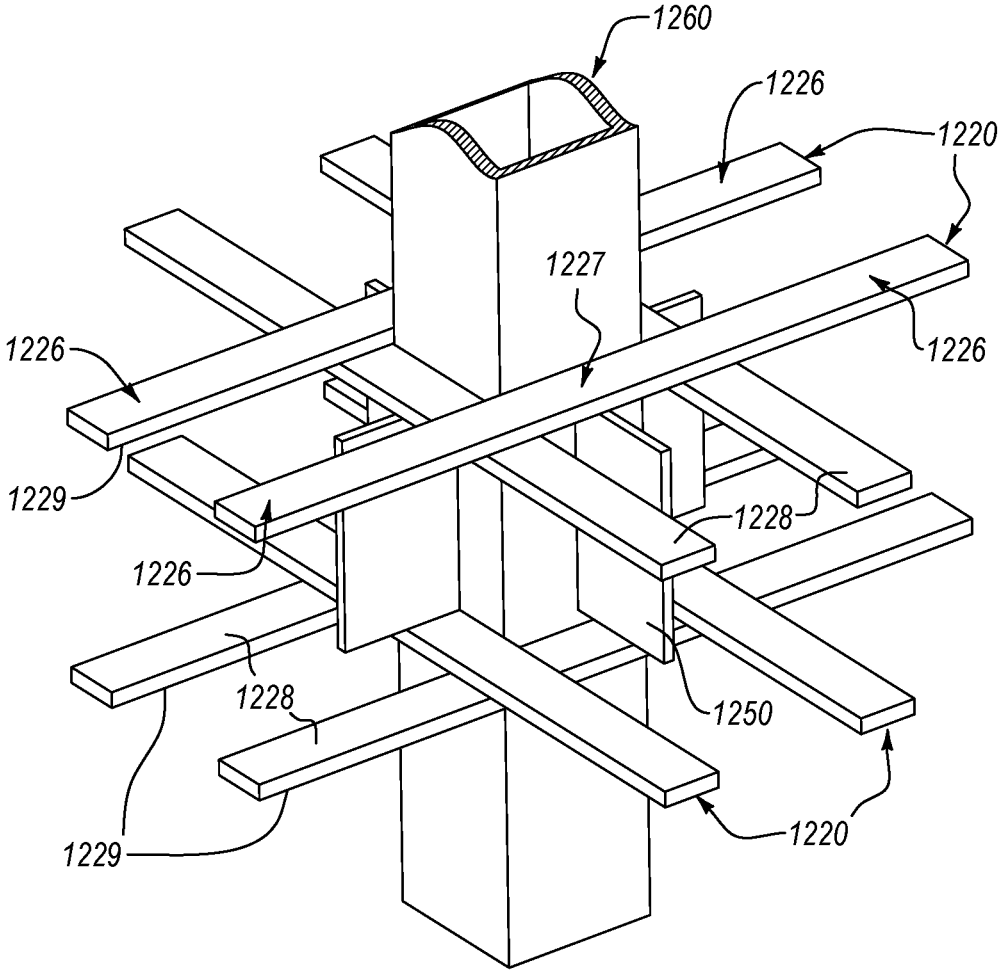

The beam-to-column connection systems disclosed herein can be used to couple a plurality of beams to the column. For example, FIG. 12A is an isometric view of a moment-resisting frame 1200 that includes a plurality of beams 200 coupled to a column 1260, according to an embodiment. FIGS. 12B and 12C are isometric views of the moment-resisting frame 1200 shown in FIG. 12A with certain components removed for ease of understanding. Except as otherwise disclosed herein, the moment-resisting frame 1200 is the same or substantially similar to any of the moment-resisting frames disclosed herein. For example, the moment-resisting frame 1200 can include a beam-to-column connection system 1201.

The moment-resisting frame 1200 includes a column 1260 and four beams 200 coupled to the column. However, it is noted that more or fewer beams 200 (e.g., one, two, three, five, etc.) can be coupled to the column 1260. The column 1260 and the four beams 200 can be the same or substantially similar to any columns and beams, respectively, disclosed herein. For example, as illustrated the column 1260 includes a box column or a hollow structural section exhibiting a square or rectangular cross-section. In such an example, the beam-to-column connection system 1201 (e.g., the splice plates 1220) can be coupled directly to the four members 1261, 1262, 1263, 1264 without the use of exterior doubler plates. However, it is noted that the beam-to-column connection system 1201 can include one or more exterior doubler plates to facilitate attachment of the splice plates 1220 to the column 1260, such as when the column 1260 includes an I-beam.

The beam-to-column connection system 1201 can include one or more of a plurality of plates 1210 (e.g., plates that include or do not include at least one shear portion), a plurality of splice plates 1220, at least one shear tab 1250, or at least one spacer 1270. Referring to FIG. 12C, which is an isometric view of the moment-resisting system 1200 with the plates 1210, spacers 1270, and beams 200 removed (to better view the splice plates 1220), the plurality of splice plates 1220 are configured to couple the beams 200 to the column 1260. In an embodiment, as shown, at least some of the splice plates 1220 can be configured to couple two or more of the beams 200 to the column 1260. In such an embodiment, each of the splice plates 1220 can include at least two splice plate-to-beam connection portions 1226 and at least one splice plate-to-column connection portion 1227 extending between the two splice plate-to-beam connection portions 1226. In an embodiment, not shown, at least some of the splice plates 1220 can be configured to only couple one beam 200 to the column 1260.

The splice plates 1220 can exhibit any suitable shape that allows the splice plates 1220 to couple two or more of the beams 200 to the column 1260. In an embodiment, as illustrated, the splice plates 1220 can exhibit a generally planar shape, such as a generally bar-like shape. In such an example, each of the splice plates 1220 can include two splice plate-to-beam connection portions 1226 and one splice plate-to-column connections portions 1227. The splice plates 1220 exhibiting the generally bar-like shape can be used to couple beams 200 that are adjacent to opposing members of the column 1260. However, the splice plates 1220 can exhibit other suitable shapes. In an example, the splice plates 1220 can exhibit a planar generally hashtag-like shape (e.g., the splice plates 1220 shown in FIG. 12C are integrally formed together) with the central space exhibiting a shape and size the corresponds to the size and shape of the column 1220. In an example, the splice plates 1220 can exhibit a planar generally X-like shape (e.g., to coupled beams 200 that are positioned next to adjacent members of column 1260), a planar shape including a single elongated member with two shorter members extending in the same direction from the single elongated member (e.g., a generally n-like shape), or another suitable shape. In an example, the splice plates 1220 can exhibit a generally L-like cross-sectional shape that is the same as or substantially similar to any of the angles disclosed herein.

In the illustrated embodiment, some of the splice plates 1220 are positioned above other of the splice plates 1220. This causes the top surfaces 1228 and bottom surfaces 1229 of some of the splice plates 1220 to be offset relative to the top surfaces 1228 and bottom surfaces 1229 of the other splice plates 1220. Referring to FIG. 12B, which is an isometric view of the moment-resisting system 1200 with the plates 1210 removed, the beams 200 can be positioned adjacent to the column 1260 such that the exterior surfaces 230 of the top flanges 210 and the bottom flanges 220 of the beams 200 are substantially aligned (e.g., an in-plane with each other). However, due to the offset between the top surfaces 1228 and the bottom surfaces 1229 of some of the plates 1220, an exterior surface 230 of the top and bottom flanges 210, 220 of the beams 200 are only aligned with some of the top and bottom surfaces 1228, 1229 of the splice plates 1220. As such, the beam-to-column connection system 1201 can include the plurality of spacers 1270. The spacers 1270 can exhibit a thickness that is about equal to the offset between the top surfaces 1228 and the bottom surfaces 1229 of some of the plates 1220. The spacers 1270 can be positioned on and coupled (e.g., welded or otherwise coupled) to selected ones of the top and bottom surfaces 1228, 1229 of the splice plates 1220 such that a surface 1271 of the spacers 1270 is substantially aligned with the exterior surface 230 of the top and bottom flanges 210, 220 of the beam 200.

Referring back to FIG. 12A, the beam-to-column connection system 1201 includes a plurality of plates 1210 that connect the beams 210 to the splice plates 1220 and, by extension, to the column 1260. The plates 1210 can be the same or substantially similar to any of the plates disclosed herein. For example, as illustrated, the plates 1210 can be the same or substantially similar to the seismic fuse plate 810 of FIG. 8. However, it is noted that at least one of the plates 1210 can be replaced with a plate that does not include a shear portion.

While various aspects and embodiments have been disclosed herein, other aspects and embodiments are contemplated. The various aspects and embodiments disclosed herein are for purposes of illustration and are not intended to be limiting.

What is claimed is:

1. A beam-to-column connection system, comprising:

a plurality of splice plates configured to be secured to a column and to be spaced from each other;

a plate including at least one first beam-connection portion and at least one first splice plate-connection portion, the at least one first beam-connection portion configured to connect to a top flange of a beam, the at least one first splice plate-connection portion configured to connect to two or more of the plurality of splice plates; and a seismic fuse plate including at least one second beam-connection portion, at least one second splice plate-connection portion, and at least one shear portion extending between the second beam-connection portion and the second splice plate-connection portion, the at least one second beam-connection portion configured to connect to a bottom flange of the beam, the at least one second splice plate-connection portion configured to connect to a remainder of the plurality of splice plates.

2. The beam-to-column connection system of claim 1, wherein each of the plurality of splice plates is configured as a sheet.

3. The beam-to-column connection system of claim 1, wherein each of the plurality of splice plates is substantially planar.

4. The beam-to-column connection system of claim 2, wherein at least some of the plurality of splice plates are welded to a doubler plate that is configured to be connected to the column.

5. The beam-to-column connection system of claim 1, wherein the plate includes at least one additional shear portion between the at least one first beam-connection portion and the at least one first splice plate-connection portion.

6. The beam-to-column connection system of claim 1, wherein the seismic fuse plate exhibits a single piece construction.

7. The beam-to-column connection system of claim 1, wherein the seismic fuse plate includes a first piece and a second piece that is distinct from the first piece.

8. The beam-to-column connection system of claim 1, wherein each of the at least one second beam-connection portion, the at least one second splice plate-connection portion, and the at least one shear portion exhibits a generally rectangular shape.

9. The beam-to-column connection system of claim 1, wherein the at least one second beam-connection portion, the at least one second splice plate-connection portion, and the at least one second shear portion define at least one exterior recess.

10. The beam-to-column connection system of claim 1, wherein the at least one shear portion defines at least one opening.

11. A moment-resisting frame, comprising:

a column;

at least one beam including a top flange, a bottom flange, and a web extending between the top flange and the bottom flange; and a beam-to-column connection system connecting the beam to the column, the beam-to-column connection system including:

a plurality of splice plates secured to the column and spaced from each other;

a plate including a first beam-connection portion and a first splice plate-connection portion, the first beam-connection portion connected to the top flange of the beam, the first splice plate-connection portion connected to two or more of the plurality of splice plates; and a seismic fuse plate including a second beam-connection portion, a second splice plate-connection portion, and a shear portion extending between the second beam-connection portion and the second splice plate-connection portion, the second beam-connection portion connected to the bottom flange of the beam, the second splice plate-connection portion connected to a remainder of the plurality of splice plates.

12. The moment-resisting frame of claim 11, wherein each of the plurality of splice plates is configured as a sheet.

13. The moment-resisting frame claim 11, wherein each of the plurality of splice plates is substantially planar.

14. The moment-resisting frame of claim 12, wherein at least some of the plurality of splice plates are welded to a doubler plate that is connected to the column.

15. The moment-resisting frame of claim 11, wherein the plate includes at least one additional shear portion between the at least one first splice plate-connection portion and the at least one first beam-connection portion.

16. The moment-resisting frame of claim 11, wherein the seismic fuse plate exhibits a single piece construction.

17. The moment-resisting frame of claim 11, wherein the seismic fuse plate includes a first piece and a second piece that is distinct from the first piece.

18. The moment-resisting frame of claim 11, wherein each of the at least one second beam-connection portion, the at least one second splice plate-connection portion, and the at least one shear portion exhibits a generally rectangular shape.

19. The moment-resisting frame of claim 11, wherein the at least one second beam-connection portion, the at least one second splice plate-connection portion, and the at least one shear portion define at least one exterior recess.

20. The moment-resisting frame of claim 11, wherein the at least one shear portion defines at least one opening.

21. The moment-resisting frame of claim 11, wherein the column is a box column or a hollow structural section exhibiting a generally rectangular cross-section.

22. The moment-resisting frame of claim 11, wherein the at least one beam includes a plurality of beams.

23. The moment-resisting frame of claim 22, wherein at least one of the plurality of splice plates is configured to connect to two or more of the plurality of beams.

24. A beam-to-column connection system, comprising:

at least four splice plates configured to be secured to a column and to be spaced from each other, the at least four splice plates exhibiting a sheet-like shape;

a plate including a first beam-connection portion and a first splice plate-connection portion, the first beam-connection portion configured to connect to a top flange of a beam, the first splice plate-connection portion configured to connect to two or more of the at least four splice plates; and a seismic fuse plate exhibiting single piece construction, the seismic fuse plate including:

a second beam-connection portion configured to connect to a bottom flange of the beam, two second splice plate-connection portions configured to connect to a remainder of the at least four splice plates, and two shear portions that each extend between the second beam-connection portion and a corresponding one of the two second splice plate-connection portions, each of the two shear portions defining at least one opening, wherein each of the second beam-connection portion, the two second splice plate-connection portions, and the two shear portions exhibit a generally rectangular shape; and wherein the second beam-connection portion, the two second splice plate-connection portions, and the two shear portions define two exterior recesses.

25. The beam-to-column connection system of claim 24, wherein the plurality of splice plates are substantially planar.

26. The beam-to-column connection system of claim 24, wherein at least some of the plurality of splice plates are welded to a doubler plate that is configured to be connected to the column.

* * * * *